US008540180B2

(12) United States Patent
Sobas

(10) Patent No.: US 8,540,180 B2
(45) Date of Patent: Sep. 24, 2013

(54) APPARATUS AND METHOD FOR DISTRIBUTION OF A FLOOR COVERING

(76) Inventor: Marc F. Sobas, Chicago, IL (US)

( * ) Notice: Subject to any disclaimer, the term of this patent is extended or adjusted under 35 U.S.C. 154(b) by 662 days.

(21) Appl. No.: 12/719,315

(22) Filed: Mar. 8, 2010

(65) Prior Publication Data

US 2011/0062276 A1 Mar. 17, 2011

Related U.S. Application Data

(60) Provisional application No. 61/158,052, filed on Mar. 6, 2009.

(51) Int. Cl.
*B65H 75/40* (2006.01)

(52) U.S. Cl.
USPC ..... 242/403; 242/557; 414/911

(58) Field of Classification Search
USPC ..... 242/403, 557; 414/24.5, 911
See application file for complete search history.

(56) References Cited

U.S. PATENT DOCUMENTS 2,656,050 A * 10/1953 Best et al. ..... 242/557
4,413,940 A * 11/1983 Southard et al. ..... 414/24.6
5,052,877 A * 10/1991 Jaaskelainen et al. ..... 414/458
5,129,462 A * 7/1992 Mail ..... 172/19
5,253,972 A * 10/1993 Drew et al. ..... 414/469
5,797,637 A 8/1998 Ervin
5,830,313 A 11/1998 Smith
6,210,095 B1 * 4/2001 Hempel et al. ..... 414/490
6,438,908 B1 8/2002 McDonald
6,523,906 B1 2/2003 Holder
6,613,188 B1 9/2003 Berg et al.
7,654,298 B2 2/2010 Goupil
8,096,745 B2 * 1/2012 Lamothe ..... 414/428
8,308,413 B2 * 11/2012 Ford ..... 414/24.6
2009/0094919 A1 4/2009 Scott et al.
2010/0037540 A1 2/2010 Atkins

OTHER PUBLICATIONS

Executed Declaration of Marc F. Sobas, dated Jun. 29, 2011.
Affidavit of Minh Lieu executed Jan. 29, 2010, 1 page.
Still photographs taken from video file named "Atlanta Carpet Roller Video. AVI," received on Nov. 21, 2009, 2 pages.

* cited by examiner

*Primary Examiner* — Sang Kim
(74) *Attorney, Agent, or Firm* — Cooley LLP

(57) ABSTRACT

An apparatus includes a frame and a roller. The frame has a first portion and a second portion. The first portion is configured to be coupled to a vehicle configured to move along a surface, such as for example, an industrial utility vehicle, scooter or the like. The roller is coupled to the second portion of the frame such that when the first portion of the frame is coupled to the vehicle the second portion of the frame and the roller are spaced apart from the surface, and the roller is configured to contact a portion of a substantially cylindrical roll. The portion of the substantially cylindrical roll is disposed between the surface and a horizontal center line of the substantially cylindrical roll.

19 Claims, 19 Drawing Sheets

APPARATUS AND METHOD FOR DISTRIBUTION OF A FLOOR COVERING

CROSS-REFERENCE TO RELATED APPLICATIONS

This application claims priority to U.S. Provisional Application Ser. No. 61/158,052, entitled "Apparatus and Method for Distribution of a Floor Covering," filed Mar. 6, 2009, which is incorporated herein by reference in its entirety.

BACKGROUND

The invention relates generally to distributing a floor covering, and more particularly to a device and methods used to effectively, move, unroll and/or roll carpet rolls along a surface.

Laying, unrolling and/or installing carpet and/or floor coverings often requires large amounts of time and effort. This is especially true when large floor area is to be covered. For example, in preparing for conventions, certain athletic events and/or other social events, large amounts of carpet are often temporarily laid to cover gymnasium floors, convention center floors and other surfaces. Some known carpet rolls used in such circumstances can be up to 12 feet in length, can have a roll diameter of up to four feet and/or can weigh as much as 1000 pounds. As such, known methods for unrolling and/or laying such carpet rolls can include having a crew of up to four (or more) individuals manually exert a force (e.g., by pushing) on the carpet roll to unroll the carpet roll. Accordingly, large amounts of time and manpower are devoted to carpet laying.

Moreover, carpet laying and/or unrolling can be a significant cause of injuries to the crew. For example, because of the size and weight of the rolls of carpet, back injuries can be a common occurrence among individuals who roll and/or unroll carpet.

Accordingly, a need exists for improved apparatus and methods for distributing a floor covering, laying carpet and/or otherwise rolling a substantially cylindrical roll.

SUMMARY

Apparatus and methods for unrolling and/or rolling a substantially cylindrical roll are disclosed herein. In some embodiments, an apparatus includes a frame and a roller. The frame has a first portion and a second portion. The first portion is configured to be coupled to a vehicle configured to move along a surface, such as for example, an industrial utility vehicle, scooter or the like. The roller is coupled to the second portion of the frame such that when the first portion of the frame is coupled to the vehicle the second portion of the frame and the roller are spaced apart from the surface, and the roller is configured to contact a portion of a substantially cylindrical roll. The portion of the substantially cylindrical roll is disposed between the surface and a horizontal center line of the substantially cylindrical roll.

DETAILED DESCRIPTION

Figure 1:
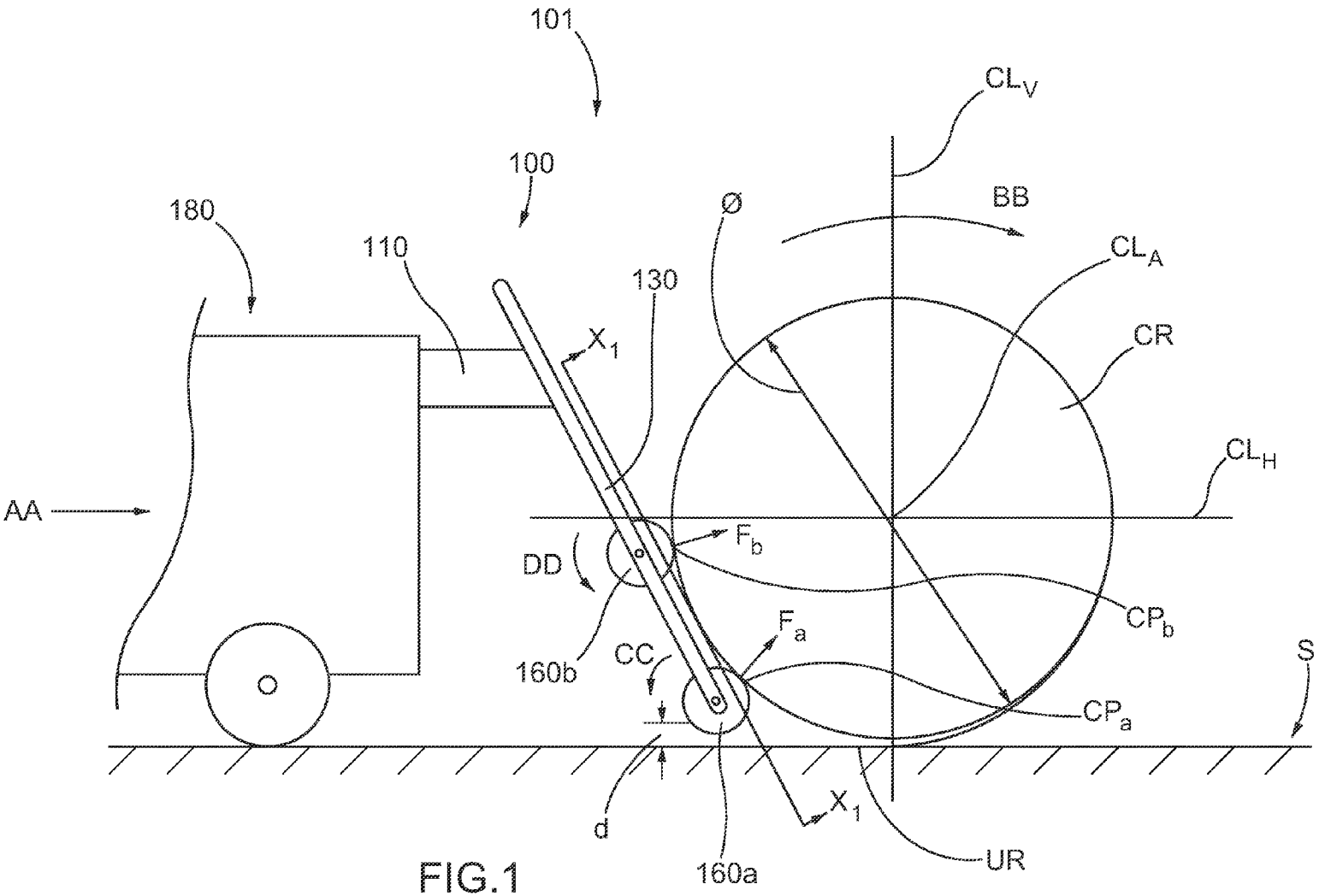
FIG. 1 is a schematic illustration of a device for moving a substantially cylindrical roll according to an embodiment in a first configuration relative to the substantially cylindrical roll.

Apparatus and methods for unrolling and/or rolling a substantially cylindrical roll are disclosed herein. In some embodiments, an apparatus includes a frame and a roller. The frame has a first portion and a second portion. The first portion is configured to be coupled to a vehicle configured to move along a surface, such as for example, an industrial utility vehicle, scooter or the like. The roller is coupled to the second portion of the frame such that when the first portion of the frame is coupled to the vehicle the second portion of the frame and the roller are spaced apart from the surface and the roller is configured to contact a portion of a substantially cylindrical roll. The portion of the substantially cylindrical roll is disposed between the surface and a horizontal center line of the substantially cylindrical roll. The substantially cylindrical roll can be, for example, a carpet roll.

In some embodiments, an apparatus includes a frame and a roller. The frame has a first portion and a second portion. The first portion is configured to be coupled to a vehicle configured to move along a surface. The roller is coupled to the second portion of the frame such that when the first portion of the frame is coupled to the vehicle the roller is spaced apart from the surface and is configured to maintain contact with an outer surface of a substantially cylindrical roll when the substantially cylindrical roll is rolled along the surface and the vehicle is moved along the surface.

In some embodiments, an apparatus includes a frame and a roller. The frame has a first portion and a second portion. The first portion of the frame is configured to be coupled to a vehicle that moves along a surface. The roller is coupled to the second portion of the frame such that when the first portion of the frame is coupled to the vehicle the roller is spaced apart from the surface by a distance and is configured to contact a portion of a substantially cylindrical roll. The substantially cylindrical roll can be, for example, a carpet roll. The second portion of the frame is configured to move relative to the first portion of the frame such that the distance can be changed. In this manner, the vertical location (e.g., the height from the surface) of the portion of the substantially cylindrical roll contacted by the roller can be adjusted.

In some embodiments, an apparatus includes a frame and a roller. The frame has a first portion and a second portion. The first portion of the frame is configured to be coupled to a vehicle, such as for example, an industrial utility vehicle, scooter or the like. The second portion of the frame includes a first frame member and a second frame member. At least a portion of the first frame member is non-linear, and at least a portion of the second frame member is non-linear. In some embodiments, for example, a portion of the first frame member and a portion of the second frame member can be curved. The roller is coupled to the first frame member and the second frame member. The roller is configured to transmit a force to a carpet roll to unroll the carpet roll when the first portion of the frame is coupled to the vehicle, the roller is in contact with a portion of the carpet roll, and the vehicle is moved.

The term "parallel" is used herein to describe a relationship between two geometric constructions (e.g., two lines, two planes, a line and a plane, two curved surfaces, a line and a curved surface or the like) in which the two geometric constructions are substantially non-intersecting as they extend substantially to infinity. For example, as used herein, a planar surface (i.e., a two-dimensional surface) is said to be parallel to a line when every point along the line is spaced apart from the nearest portion of the planar surface by a substantially equal distance. Similarly, a line is said to be parallel to a curved surface when the line and the curved surface do not intersect as they extend to infinity and when every point along the line is spaced apart from the nearest portion of the curved surface by a substantially equal distance. Two geometric constructions are described herein as being "parallel" or "substantially parallel" to each other when they are nominally parallel to each other, such as for example, when they are parallel to each other within a tolerance. Such tolerances can include, for example, manufacturing tolerances, measurement tolerances or the like.

The terms "perpendicular," "orthogonal," and/or "normal" are used herein to describe a relationship between two geometric constructions (e.g., two lines, two planes, a line and a plane, two curved surfaces, a line and a curved surface or the like) in which the two geometric constructions intersect at an angle of approximately 90 degrees within at least one plane. For example, as used herein, a line is said to be normal to a curved surface when the line and a portion of the curved surface intersect at an angle of approximately 90 degrees within a plane. Two geometric constructions are described herein as being, for example, "perpendicular" or "substantially perpendicular" to each other when they are nominally perpendicular to each other, such as for example, when they are perpendicular to each other within a tolerance. Such tolerances can include, for example, manufacturing tolerances, measurement tolerances or the like.

Figure 2:
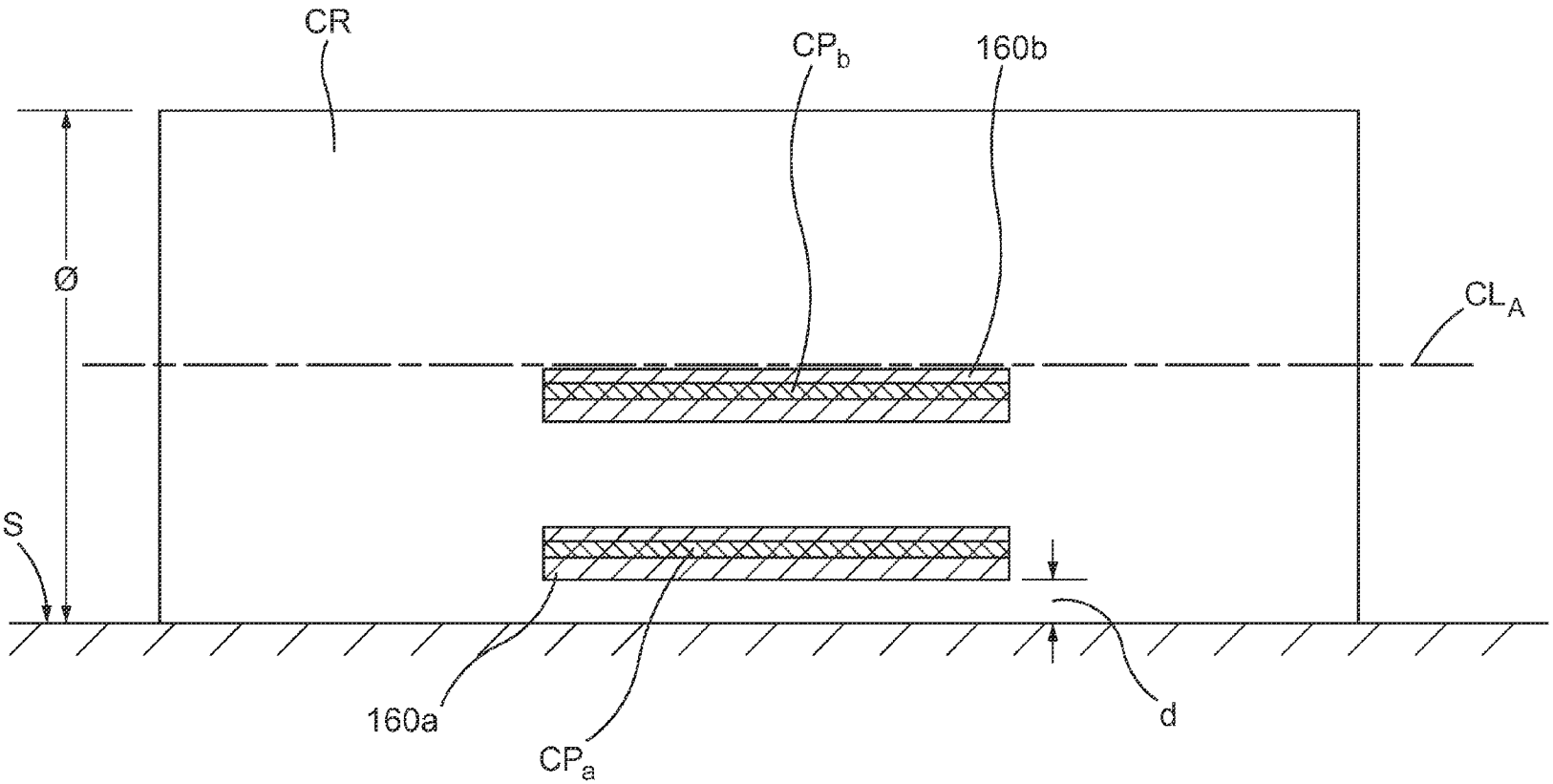
FIG. 2 is a cross-sectional view of a portion of the device shown in FIG. 1 taken along line $X_1$-$X_1$ in FIG. 1.

FIGS. 1 and 2 are schematic illustrations of a rolling and/or unrolling device 101 according to an embodiment. As described herein, the rolling and/or unrolling device 101 can be coupled to a vehicle 180 and used to move, roll and/or unroll a substantially cylindrical roll CR along a surface S. The vehicle 180 can be any device for carrying and/or moving people and/or objects, such as, for example, an industrial utility vehicle, scooter or the like.

The substantially cylindrical roll CR has a diameter $\phi$, and defines a horizontal center line $CL_H$, a vertical center line $CL_V$ and an axial center line $CL_A$ (see FIG. 2). The axial center line $CL_A$ substantially intersects the center of the substantially cylindrical roll CR, and is the axis about which the substantially cylindrical roll CR rotates when moved, rolled and/or unrolled along a surface S. The horizontal center line $CL_H$ substantially intersects the center of the substantially cylindrical roll CR, and is substantially parallel to the surface S. The vertical center line $CL_V$ substantially intersects the center of the substantially cylindrical roll CR, and is substantially normal to the surface S. The horizontal center line $CL_H$, the vertical center line $CL_V$ and the axial center line $CL_A$ are all substantially normal to each other. As described in more detail herein, in some instances when the substantially cylindrical roll CR is rolled, unrolled and/or distributed over the surface S, the diameter $\phi$ is changes as the substantially cylindrical roll CR is rolled, unrolled and/or distributed.

The substantially cylindrical roll (or object) CR can be any substantially cylindrical object that is to be rolled along the surface S. In some embodiments, the substantially cylindrical roll CR can be a roll of material that is to be unrolled and/or distributed over the surface S. The material to be unrolled can be, for example, carpet, floor covering, fabric, vinyl, paper, sod or the like. In other embodiments, the substantially cylindrical roll CR can be an object that is not "unrolled" or distributed, such as for example, a barrel, a shipping tube, drainage pipes or the like.

The rolling and/or unrolling device 101 includes a frame 100 and two rollers 160*a*, 160*b* coupled to the frame 100. The frame 100 includes a first portion 110 and a second portion 130. The first portion 110 is coupled to the vehicle 180. The first portion 110 can be coupled to the vehicle 180 via any suitable mechanism, such as, for example, a weld joint, screws, clamps, and/or the like. In some embodiments, the first portion 110 of the frame 100 can be removably coupled to the vehicle 180. In this manner, the device 101 can be removed from the vehicle 180 and stored when not in use. In other embodiments, the first portion 110 of the frame 100 can be fixedly coupled to the vehicle 180.

The first roller 160*a* and the second roller 160*b*, which can each be any suitable roller (e.g., a cylindrical roller having an outer "roller" member that rotates about a spindle), are coupled to the second portion 130 of the frame 100. The first roller 160*a* and the second roller 160*b* are coupled to the frame such that the first roller 160*a* and the second roller 160*b* can rotate relative to the second portion 130 of the frame 100. In particular, the first roller 160*a* is coupled to the second portion 130 of the frame 100 such that the second portion 130 of the frame 100 and the first roller 160*a* are spaced apart from the surface S when the roller 160*a* contacts the substantially cylindrical roll CR. As shown in FIGS. 1 and 2, the roller 160*a*, which is the portion of the device 101 closest to the surface S, is spaced apart from the surface S by a distance d. In this manner, the second portion 130 of the frame 100 and the first roller 160*a* will not scrape, contact and/or scratch the surface S and/or the unrolled portion UR of the substantially cylindrical roll CR when the device 101 is used to move, roll and/or unroll the substantially cylindrical roll CR along the surface S. Although the roller 160*a* is shown and described as being the portion of the device 101 closest to the surface S, in other embodiments, a portion of the second portion 130 of the frame 100 or the second roller 160*b* can be the portion of the device 101 closest to the surface S.

FIG. 2 is a cross-sectional view of the first roller 160*a* and the second roller 160*b* taken along line $X_1$-$X_1$ in FIG. 1. As shown in FIG. 2, the first roller 160*a* and the second roller 160*b* are coupled to the second portion 130 of the frame 100 such that the first roller 160*a* contacts a first contact portion CPa of the substantially cylindrical roll CR and the second roller 160*b* contacts a second contact portion CPb of the substantially cylindrical roll CR. The first contact portion CPa and the second contact portion CPb are shown as being regions with double cross-hatching in FIG. 2. The first contact portion CPa and the second contact portion CPb are shown as being regions (or areas) along the outer surface of the substantially cylindrical roll CR, rather than one-dimensional portions (e.g., lines), because when the device 101 is used to move, roll and/or unroll the substantially cylindrical roll CR, a portion of the roll CR and/or the first roller 160*a* and the second roller 160*b* may deform, thereby resulting in a two-dimensional contact area between the rollers 160*a*, 160*b* and the surface of the substantially cylindrical roll CR. In other embodiments, however, the first contact portion CPa and/or the second contact portion CPb can be a line along which the first roller 160*a* and/or the second roller 160*b* contact the substantially cylindrical roll CR.

As shown in FIG. 1, the first contact portion CPa is disposed between the surface S and the horizontal center line $CL_H$ of the substantially cylindrical roll CR. Similarly stated, the first contact portion CPa is on the lower half (i.e., the half closest to the surface S) of the substantially cylindrical roll CR. In this manner, when the device 101 is used to move, roll and/or unroll the substantially cylindrical roll CR, a portion of a horizontal force produced by the vehicle 180 is transmitted as a vertical, upward or lifting force on the substantially cylindrical roll CR. Moreover, in certain situations this arrangement allows at least the first roller 160*a* to maintain contact with the substantially cylindrical roll CR as the substantially cylindrical roll CR is unrolled and the diameter $\phi$ decreases. Although the second contact portion CPb is shown as being disposed between the surface S and the horizontal center line $CL_H$, in other embodiments, the second contact portion CPb can be in any suitable location on the substantially cylindrical roll CR.

Moreover, as shown in FIG. 1, when the first roller 160*a* and/or the second roller 160*b* are in contact with the substantially cylindrical roll CR, the second portion 130 of the frame 100 is spaced apart from the substantially cylindrical roll CR. In this manner, the second portion 130 of the frame 100 will not scrape, contact and/or scratch the substantially cylindrical roll CR when the device 101 is used to move, roll and/or unroll the substantially cylindrical roll CR along the surface S. In other embodiments, however, a portion of the second portion 130 of the frame 100 can contact the substantially cylindrical roll CR. For example, in some embodiment, the second portion 130 of the frame 100 can include a guide member (not shown in FIG. 1 or 2) that contacts the substantially cylindrical roll CR to guide and/or maintain alignment of the substantially cylindrical roll CR and/or the device 101.

In use, after the device 101 is coupled to the vehicle 180, the vehicle 180 is moved as shown by the arrow AA until the first roller 160*a* and/or the second roller 160*b* contact the outer surface of the substantially cylindrical roll CR, as described above. Further movement of the vehicle 180 in the direction shown by arrow AA causes the first roller 160*a* and/or the second roller 160*b* to exert a force on the substantially cylindrical roll CR. More particularly, the first roller 160*a* exerts a force Fa on the substantially cylindrical roll CR that is substantially normal to the first contact portion CPa (and/or the tangent line intersecting the first contact portion CPa). Similarly, in certain circumstances, the second roller 160*b* exerts a force Fb on the substantially cylindrical roll CR that is substantially normal to the second contact portion CPb (and/or the tangent line intersecting the second contact portion CPb). As described above, the force Fa and the force Fb each have a horizontal component and a vertical component that cooperatively act to rotate the substantially cylindrical roll CR about its axial center line $CL_A$, as shown by the arrow BB in FIG. 1.

When the substantially cylindrical roll CR is rotated about its axial center line $CL_A$, as shown by the arrow BB in FIG. 1 the first roller 160*a* rotates as shown by the arrow CC in FIG. 1 and/or the second roller 160*b* rotates as shown by the arrow DD in FIG. 1. Similarly stated, when the substantially cylindrical roll CR is rotated about its axial center line $CL_A$, the first roller 160*a* and/or the second roller 160*b* can roll along the outer surface of the substantially cylindrical roll CR. Said another way, when the substantially cylindrical roll CR is rotated about its axial center line $CL_A$, the first roller 160*a* and/or the second roller 160*b* can maintain rolling contact with the outer surface of the substantially cylindrical roll CR. In this manner, the first roller 160*a* and/or the second roller 160*b* can exert a force on the substantially cylindrical roll CR to move, roll and/or unroll a substantially cylindrical roll CR while minimizing the scraping, sliding contact and/or frictional losses between the device 101 (e.g., any portion of the frame 100, the first roller 160*a* and/or the second roller 160*b*).

Although the device 101 is shown and described as having a first roller 160*a* and a second roller 160*b* that each contact a portion (e.g., the first contact portion CPa and the second contact portion CPb, respectively) of the substantially cylindrical roll CR, in other embodiments, only a single roller can contact a portion of the substantially cylindrical roll CR. Similarly stated, in certain instances, the geometric relationship between the rollers 160*a*, 160*b* and the substantially cylindrical roll CR can be such that only one of the first roller 160*a* or the second roller 160*b* contacts the outer surface of the substantially cylindrical roll CR. More particularly, the diameter of the first roller 160*a*, the diameter of the second roller 160*b*, the distance and angle through which the first roller 160*a* is spaced apart from the second roller 160*b* and/or the diameter $\phi$ of the substantially cylindrical roller CR can be such that only one of the first roller 160*a* or the second roller 160*b* contacts the outer surface of the substantially cylindrical roll CR. For example, in certain instances, the diameter $\phi$ of the substantially cylindrical roll CR can be small enough such that the second roller 160*b* does not contact the substantially cylindrical roll CR. Conversely, in other instances, the diameter $\phi$ of the substantially cylindrical roll CR can be sized and/or the second frame member 130 can be positioned at an angle relative to the surface S such that the first roller 160*a* does not contact the substantially cylindrical roll CR.

Figure 3:
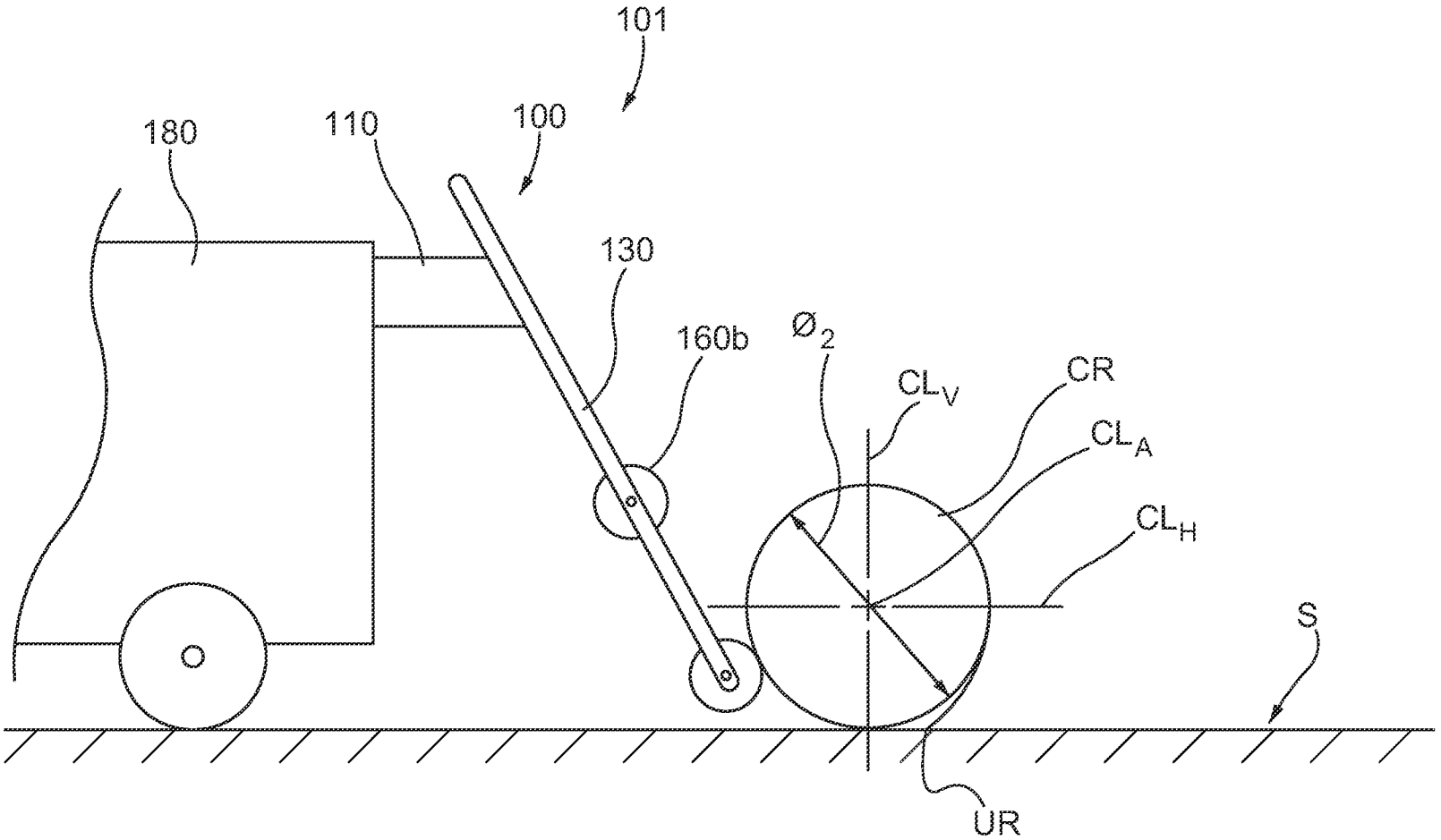
FIG. 3 is a schematic illustration of the device shown in FIG. 1 in a second configuration relative to the substantially cylindrical roll.
Figure 4:
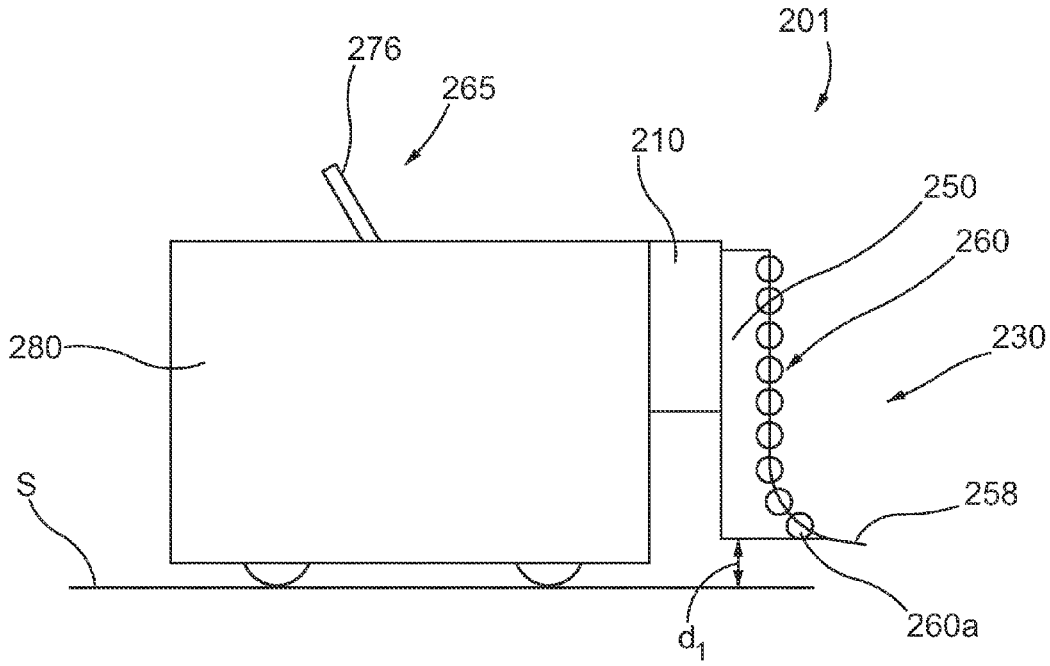
FIGS. 4 and 5 are schematic illustrations of device according to an embodiment having a roller assembly in a first position and a second position, respectively.

Moreover, in certain situations when the substantially cylindrical roll CR is unrolled, rolled and/or distributed over the surface S, the diameter $\phi$ changes (i.e., increases or decreases) as the substantially cylindrical roll CR is rolled, unrolled and/or distributed. For example, FIG. 3 is a schematic illustration showing the device 101 and the substantially cylindrical roll CR after a portion of the material of the substantially cylindrical roll CR has been unrolled, distributed and/or "laid" about the surface S. As shown in FIG. 3, because a portion of the material of the substantially cylindrical roll CR has been removed from the roll, the diameter $\phi$2 of the substantially cylindrical roll CR is less than the initial diameter ϕ (as shown in FIGS. 1 and 2). This decrease of the diameter results in only the first roller 160*a* contacting the substantially cylindrical roll CR during a portion of the unrolling operation.

Although the first roller 160*a* and the second roller 160*b* are shown as being coupled to the second portion 130 of the frame 100 in a fixed position relative to each other, in other embodiments, the first roller 160*a* and/or the second roller 160*b* can be movably coupled to the second portion 130 of the frame 100. For example in some embodiments, the first roller 160*a* and/or the second roller 160*b* can be coupled to the second portion 130 of the frame 100 such that the distance between the first roller 160*a* and the second roller 160*b* (i.e., the roller spacing) can be adjusted. In this manner, the roller spacing can be adjusted so that the device can accommodate a number of different cylindrical rolls having different diameters. In other embodiments, the roller spacing can change when the device 100 is rolling, unrolling and/or moving the substantially cylindrical roll CR. In some embodiments, for example, the first roller 160*a* and/or the second roller 160*b* can be coupled to the second portion 130 of the frame 100 via a biasing member to allow the first roller 160*a* and/or the second roller 160*b* to move relative to the second portion 130 of the frame 100. Such a "dynamic adjustment" arrangement can ensure that the first roller 160*a* and the second roller 160*b* each maintain rolling contact with the substantially cylindrical roll CR during the rolling, unrolling and/or moving operation and/or as the diameter of the substantially cylindrical roll CR changes.

Although the second portion 130 of the frame 100 is shown as being in a fixed position and/or orientation relative to the first portion 110 of the frame 100, in other embodiments, the second portion 130 of the frame 100 can move relative to the first portion 110 of the frame. In some embodiments, for example, the second portion 130 of the frame 100 can rotate and/or translate relative to the first portion 110 of the frame.

Although the second portion 130 of the frame 100 is shown as being in a fixed position relative to the first portion 110 of the frame 100, in other embodiments, the second portion 130 of the frame 100 can move relative to the first portion 110 of the frame 100. In some embodiments, for example, the second portion 130 of the frame 100 can rotate and/or translate relative to the first portion 110 of the frame 100 and/or the surface S. In this manner, the angle of orientation of the second portion 130 of the frame and/or the distance d can be adjusted.

Although the device 101 is shown and described as including two rollers (i.e., the first roller 160*a* and the second roller 160*b*), in other embodiments, a device can include any number of rollers. For example, in some embodiments, a device can include a single roller. In other embodiments, a device can include a set of rollers that includes, three, four or more rollers. In some such embodiments, the rollers can be coupled to a frame such that the axes of rotation of the rollers define a curved surface. Similarly stated, in some such embodiments, the rollers can be coupled to a frame such that the axes of rotation of the rollers are not linearly aligned. For example, FIGS. 4-9 are schematic illustrations of a rolling and/or unrolling device 201 according to an embodiment that includes multiple rollers and a height adjustment mechanism configure to adjust the position of the rollers relative to the surface and/or the roll. As described herein, the rolling and/or unrolling device 201 can be coupled to a vehicle 280 and used to move, roll and/or unroll the substantially cylindrical roll CR along a surface S (see e.g., FIG. 7).

The device 201 includes an adapter 210, a roller assembly 230 and a height adjustment mechanism 265. The adapter 210 can be any frame and/or mount configured to couple the roller assembly 230 to the vehicle 280. In some embodiments, for example, the adapter 210 is a rigid mount mechanism. In other embodiments, the adapter 210 can be a flexible, deformable and/or movable mount mechanism. In some embodiments, the adapter 210 can include one or more frame members that correspond to, fit within and/or matingly engage the front portion of the vehicle 280.

In some embodiments, the adapter 210 can be releasably coupled to the front portion of the vehicle 280. In such embodiments, the adapter 210 can include clamps, bolts and/or any other mechanism to releasably couple the adapter 210 to the front portion of the vehicle 280. In other embodiments, the adapter 210 is releasably coupled to the vehicle 280 by non-mechanical means, such as, for example, an electromagnet, a pneumatic clamp, a suction clamp, and/or the like.

Once coupled to the vehicle 280, the adapter 210 does not move with respect to the vehicle 280. In other embodiments, however, an adapter can be configured to move (e.g., translate and/or rotate) relative to the vehicle 280. For example, in some embodiments, the adapter 210 can move relative to the vehicle 280 when the roller assembly 230 is moved relative to the vehicle 280 between its first position (FIG. 4) and its second position (FIG. 5), as described in further detail herein. In yet other embodiments, the adapter 210, roller assembly 230 and the vehicle 280 are not configured to move with respect to each other.

Figure 7:
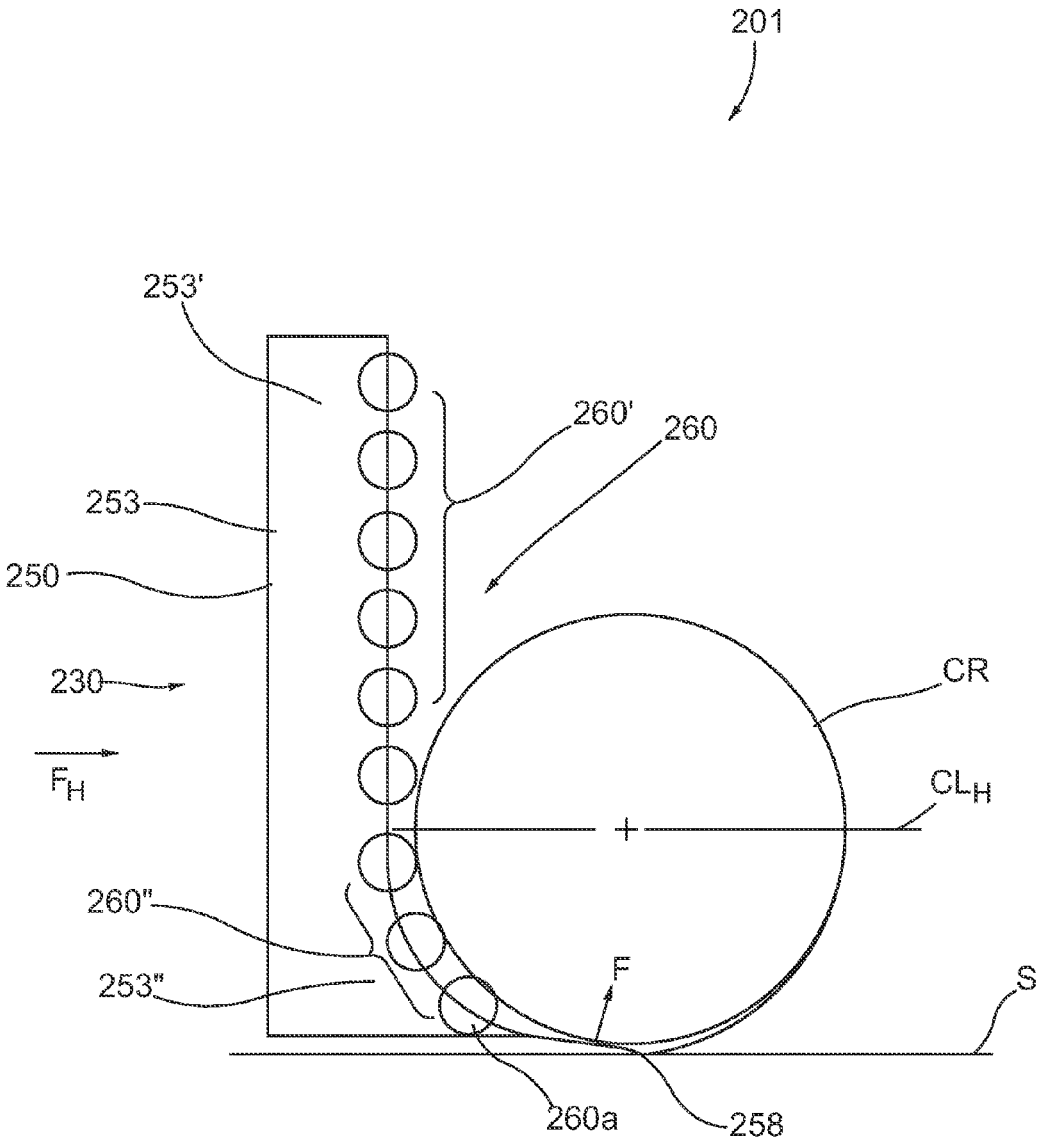
FIG. 7 is a schematic illustration of a portion of the device shown in FIG. 6.
Figure 8:
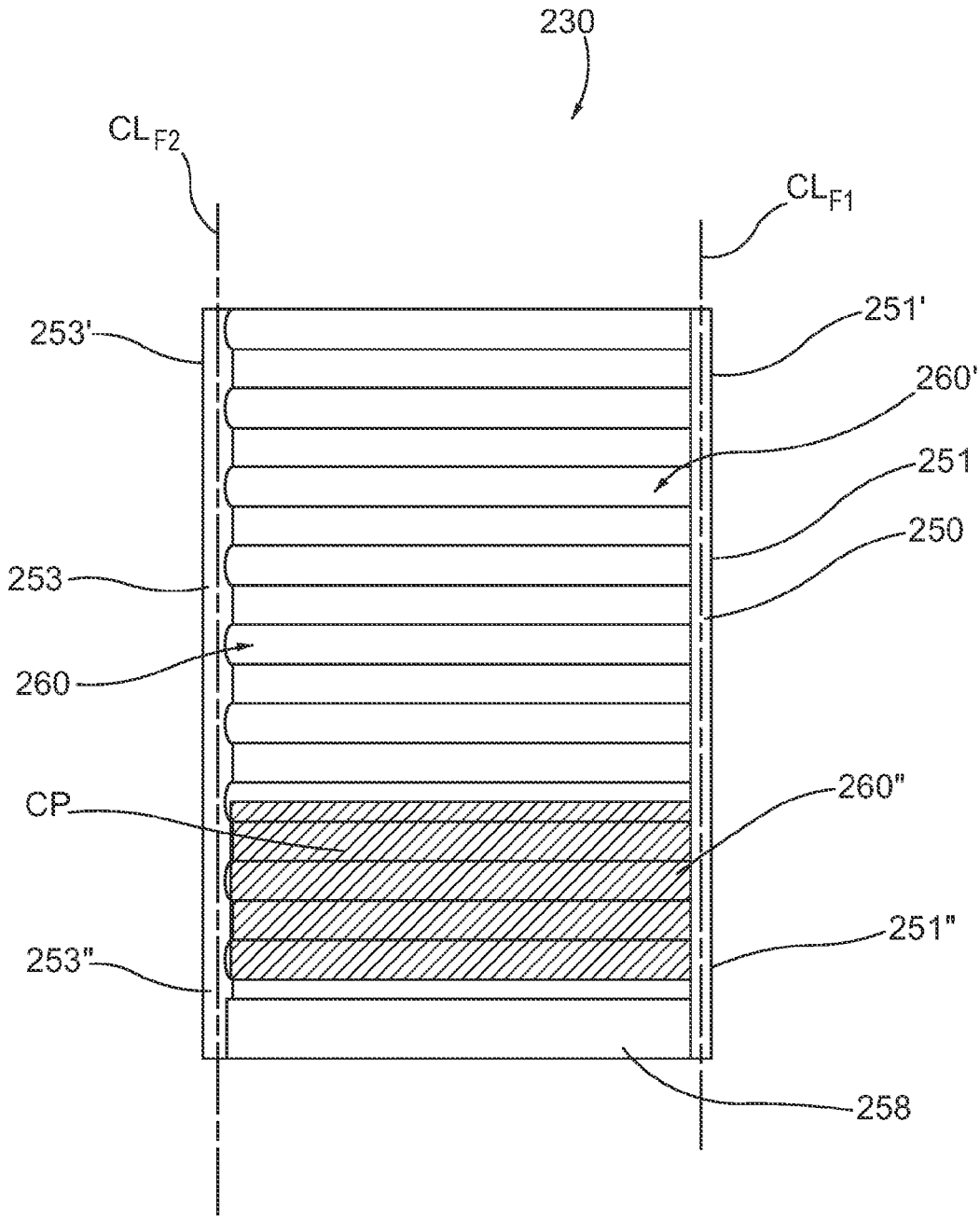
FIG. 8 is a front view schematic illustration of a portion of the device shown in FIGS. 4 and 5.
Figure 9:
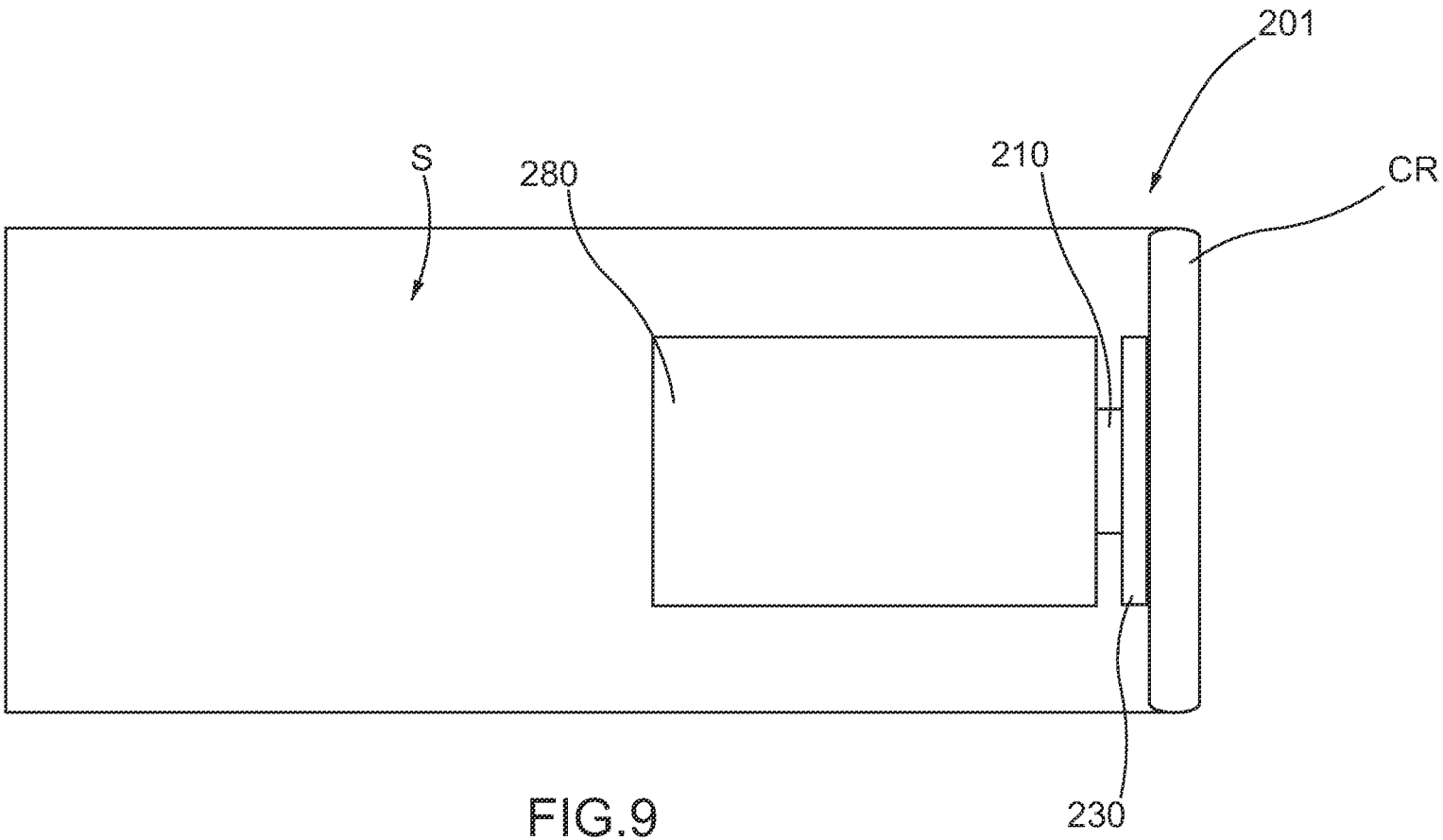
FIG. 9 is a top view schematic illustration of the device shown in FIGS. 4 and 5 with a roller assembly in contact with the substantially cylindrical roll.

The roller assembly 230 includes a frame 250, a roll support member 258 and multiple rollers 260. FIGS. 7 and 8 show a detailed side view and a detailed front view, respectively, of the roller assembly 230. The frame 250 is slidably mounted to the adapter 210. In this manner, the roller assembly 230 can be moved relative to the adapter 210. Thus, the height of the roller assembly 230 relative to the vehicle 280 and/or the surface S (e.g., the floor) can be selectively adjusted. In this manner, the roller assembly 230 can be raised when not in use, adjusted to engage a variety of different substantially cylindrical rolls CR or the like. The position of roller assembly 230 can be controlled such that bottom of roller assembly 230 can be positioned at a desired position from the surface S (e.g., ¾ inch). In this manner, the frame 250, the roll support member 258 and the set of rollers 260 are spaced apart from the surface S when the rollers 260 contact the substantially cylindrical roll CR, as shown in FIG. 7.

In some embodiments, the roller assembly 230 can include wheels configured to contact the surface S and/or roll over any material unrolled and/or removed from the substantially cylindrical roll CR when the device 201 is unrolling, rolling and/or moving the substantially cylindrical roll CR. In other embodiments, the frame does not include wheels.

As shown in FIG. 8, the frame 250 has a frame member 251 and a frame member 253 to which and/or between which the rollers 260 are mounted. The frame member 251 is substantially parallel to the frame member 253. Similarly stated, a center line $CL_{F1}$ of the frame member 251 is substantially parallel to a center line $CL_{F2}$ of the frame member 253. In this manner, the frame member 251 is spaced apart from the frame member 253 by a distance that substantially corresponds to the length of the rollers 260. In other embodiments, however, the frame member 251 can be non-parallel to the frame member 253.

The frame member 251 includes a linear portion 251' and a non-linear and/or curved portion 251". The frame member 253 includes a linear portion 253' and a non-linear and/or curved portion 253". The non-linear and/or curved portion 253" of the frame member 253 can be seen, for example, in FIG. 7 (since FIG. 7 is a side view, only the frame member 253 is shown in FIG. 7). Although the non-linear and/or curved portion 251" is shown as being curved, in other embodiments, the non-linear and/or curved portion 251" can include multiple linear (or straight) portions joined to form a non-linear portion. A subset 260' of the rollers 260 are coupled to and/or between the linear portion 251' of the frame member 251 and the linear portion 253' of the frame member 253. Accordingly, the axes of rotation of the subset 260' the rollers 260 is linearly aligned. The subset 260' of rollers 260 are configured to engage large rolls (e.g., substantially cylindrical rolls having a diameter up to four feet). Accordingly, in certain instances the subset 260' of rollers 260 does not engage and/or contact the substantially cylindrical roll CR.

As shown in FIG. 7, at least one of the rollers 260 is coupled to and/or between the non-linear and/or curved portion 251" and the non-linear and/or curved portion 253". In this manner, the axes of rotation of at least three of the rollers 260 can be non-linearly aligned. Similarly stated, the axes of rotation of at least three of the rollers 260 can define a curved surface. In some embodiments, the radius of curvature of the curved portion 253' and/or the curved surface defined by the axes of rotation of at least three of the rollers 260 can substantially correspond to diameter of the substantially cylindrical roll CR.

In some embodiments, the frame 250 can include multiple members movably coupled to each other such that the radius of curvature of the curved surface defined by the axes of rotation of at least three of the rollers 260 can change as the substantially cylindrical roll CR is unrolled. In some such embodiments, for example, the individual members and/or the rollers 260 can be biased (e.g., via springs or the like) in a position having a nominal radius of curvature (e.g., nine inches), and configured to move to adjust the radius of curvature as the substantially cylindrical roll CR is unrolled.

The rollers 260 coupled between and/or adjacent the non-linear and/or curved portion 251" and the non-linear and/or curved portion 253" are configured such that they define a carpet engagement area CP (shown as the shaded region in FIG. 8). In some embodiments, the carpet engagement area CP can define a radius of curvature that corresponds and/or approximates a radius of the substantially cylindrical roll CR. In some embodiments, the carpet engagement area CP can have a fixed arrangement (e.g., defining a radius of curvature is 9 inches, 12 inches, or any suitable value). In other embodiments, the carpet engagement area CP can define a radius of curvature that varies. In such embodiments, the rollers 260 can be movable with respect to each other such that the contour of the carpet engagement area CP changes as the substantially cylindrical roll CR is unrolled, as described above. In such a manner, the carpet engagement area can accommodate different sizes of carpet rolls.

The roll support member 258 is coupled to the frame 250 and is configured to provide support for the substantially cylindrical roll CR as it is rolled, unrolled and/or moved along the surface S. As shown in FIG. 7, the leading edge of the roll support member 258 extends beyond the bottom most roller 260*a*. In this manner, the roll support member 258 can provide an initial point of contact with the substantially cylindrical roll CR. The leading edge of the roll support member 258 can extend beyond the bottom most roller 260*a* by any suitable amount (e.g., approximately 3 inches, more than 3 inches or less than 3 inches).

The roll support member 258 is non-parallel to the surface S and can define any suitable angle with the surface S when the substantially cylindrical roll CR is being rolled, unrolled and/or moved. In some embodiments, for example, the roll support member 258 defines an angle with the surface S that is greater than 75 degrees. In other embodiments, the roll support member 258 forms an angle with the surface S of less than 75 degrees. In such embodiments, the angle can be 60 degrees, 45 degrees or the like. The angle of the roll support member 258 with respect to the surface S can influence the vertical component of a force F (see FIG. 7) exerted by the roll support member 258 on a portion of the substantially cylindrical roll CR, as described in further detail herein. As shown, because the roll support member 258 is not parallel or perpendicular to the floor, a portion of a horizontal force $F_H$ produced by the vehicle 280 is transmitted via the roll support member 258 as a lifting force (i.e., a vertical force) to aid in rolling, unrolling and/or moving the substantially cylindrical roll CR.

In use, the rollers 260 and the roll support member 258 are configured cooperatively to engage the substantially cylindrical roll CR such that translational force (in horizontal direction) results in rotational motion (i.e., rolling motion) of the substantially cylindrical roll CR, as further described herein. The rollers 260 and the roll support member 258 are cooperatively configured to engage the carpet roll CR such that at least one of the rollers 260 engages the substantially cylindrical roll CR and such that the roll support member 258 is disposed between the surface S and a portion of the substantially cylindrical roll CR. More particularly, the rollers 260 and the roll support member 258 are cooperatively configured such that the roll support member 258 and at least one of the rollers 260 engages the substantially cylindrical roll CR between the surface S and a horizontal center line $CL_H$ of the substantially cylindrical roll CR. This arrangement allows the roll support member 258 and/or the at least one roller 260 to transmit a vertical force to the substantially cylindrical roll CR as the vehicle 280 moves in a horizontal direction along the surface S.

Figure 5:
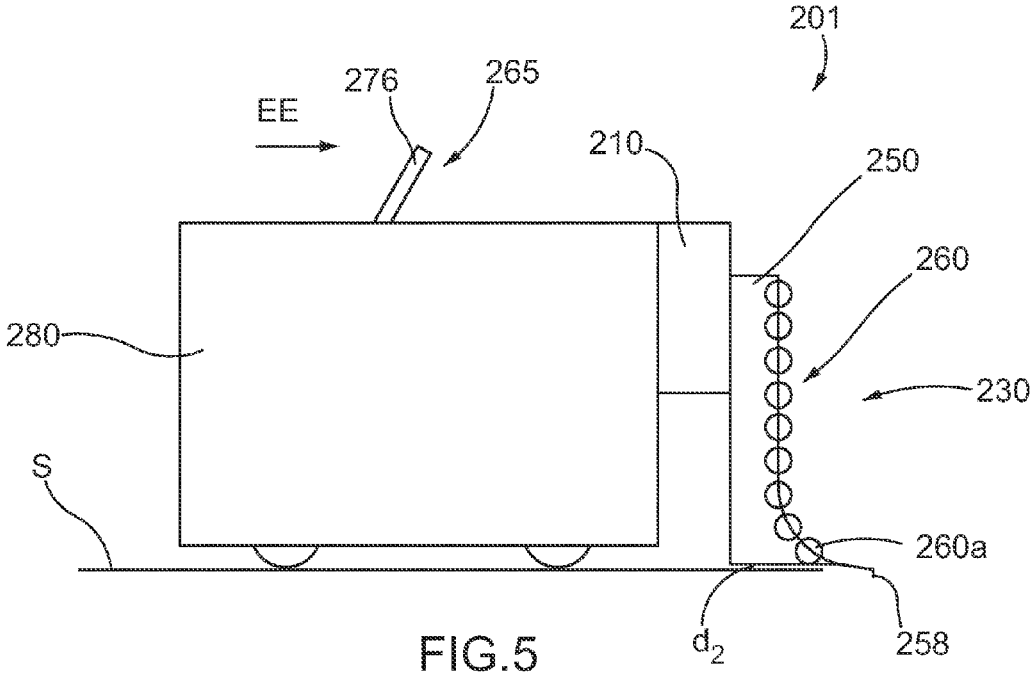
Figure 6:
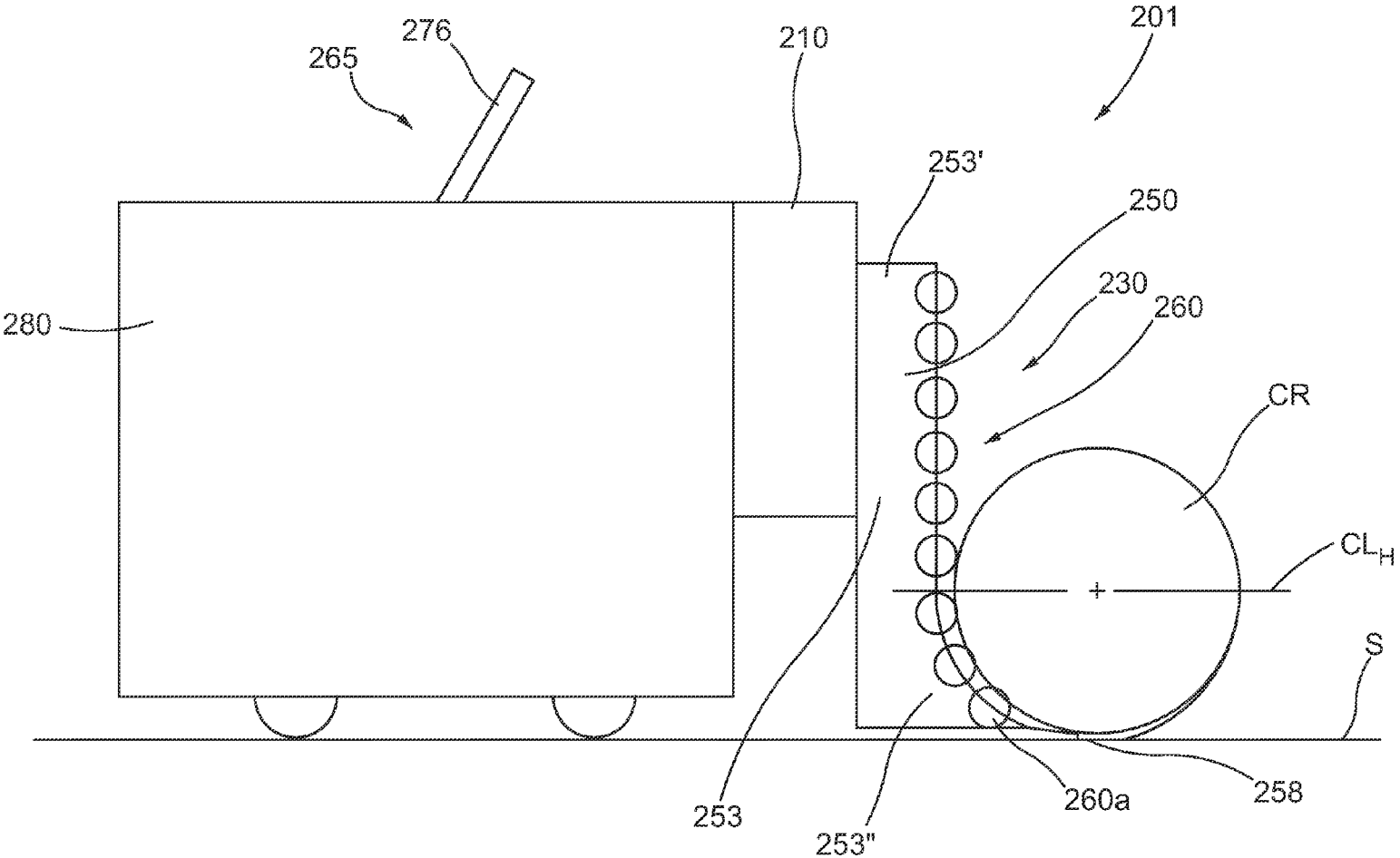
FIG. 6 is a side view of the device shown in FIGS. 4 and 5 with the roller assembly in the second position and in contact with a substantially cylindrical roll.

The roller assembly 230 can be moved relative to the adapter 210 between a first position (FIG. 4) and a second position (FIG. 5). When the roller assembly 230 is in its first position, the bottom portion of the frame 250 and/or or the lower-most roller 260 is spaced apart from the surface S by a first distance d1. When the roller assembly 230 is in its second position, the bottom portion of the frame 250 and/or or the lower-most roller 260 is spaced apart from the surface S by a second distance d2, which is less than the first distance d1. In the second position, the device 201 is configured to unroll the substantially cylindrical roll CR, as described detail herein. In some embodiments, for example, the second distance d2 can be approximately three-quarters of an inch. In other embodiments, the second distance d2 can be any distance at which the substantially cylindrical roll CR can be unrolled.

As described in more detail herein, the height and/or position of the roller assembly 230 can be adjusted using any suitable mechanism, such as, for example, a pulley system, electric motor or the like. Although shown as height adjustment, the roller assembly 230 can also be configured to move relative to the adapter 210 in a horizontal direction (e.g., side to side), in an angular direction (e.g., pitch) or the like.

The height adjustment mechanism 265 includes a lever 276 configured to control the height of the roller assembly 230. The lever 276 has a first position (FIG. 4) and a second position (FIG. 5) corresponding to the first position of the roller assembly 230 and the second position of the roller assembly 230. Accordingly, when the lever 276 is in its first position, the roller assembly 230 is raised. When the lever 276 is in its second position, the roller assembly 230 is in close proximity to the floor and is configured to unroll the substantially cylindrical roll CR.

To move the lever 276 from its first position to its second position, the lever 276 is moved in the direction shown by the arrow EE in FIG. 5. This causes the roller assembly 230 to move with respect to the adapter 210 into its second position, in close proximity to the floor, as described above. Similarly, to move the lever 276 from its second configuration to its first configuration, the lever 276 is moved in the direction substantially opposite the direction shown by the arrow EE. This causes the roller assembly 230 to move with respect to the adapter 210 into its first position.

Figure 10:
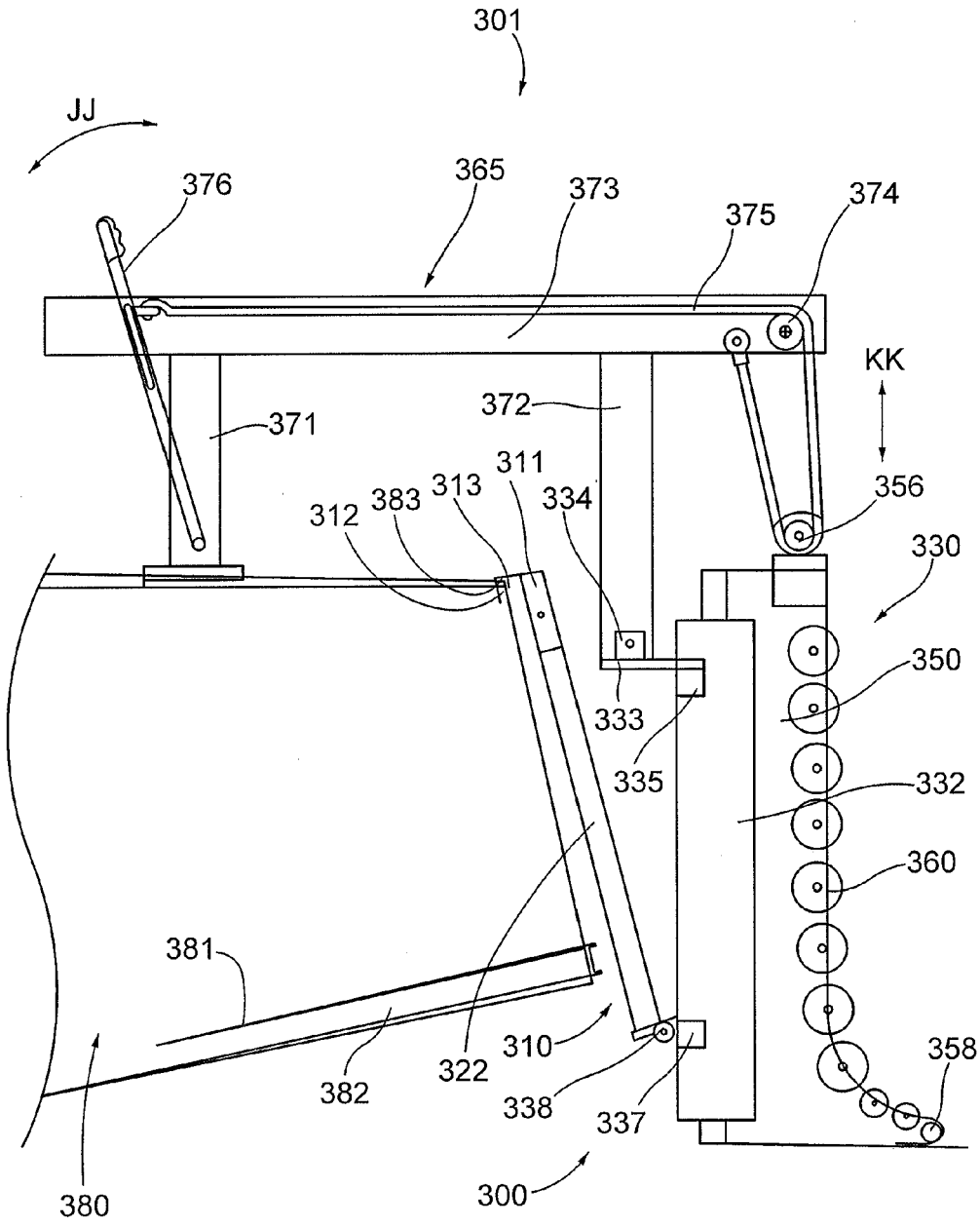
FIGS. 10 and 11 are side views of different portions of a device for moving a substantially cylindrical roll according to an embodiment.
Figure 11:
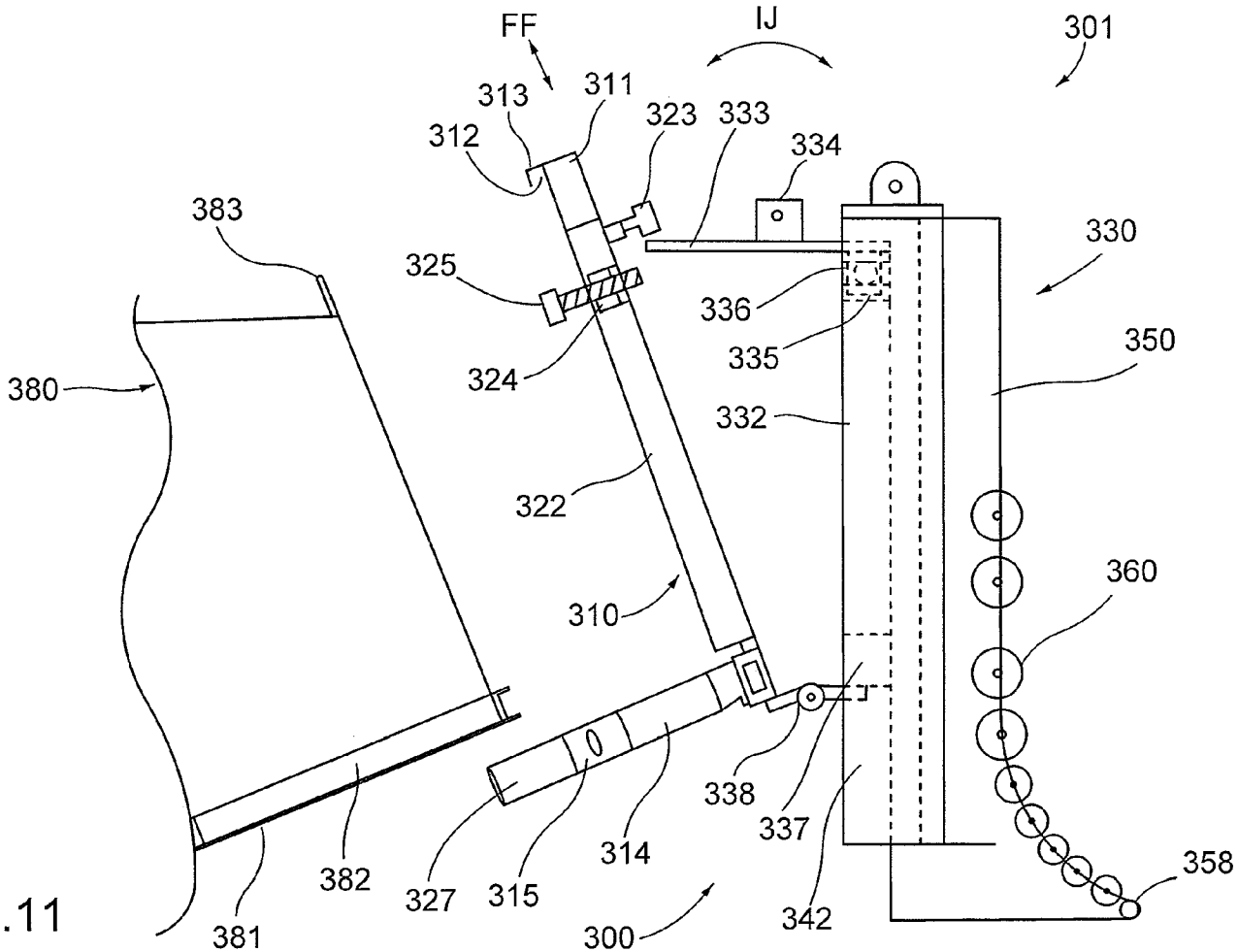

FIGS. 10 and 11 show various portions of a rolling and/or unrolling device 301 (referred to herein as the device 301) according to an embodiment. As described herein, the device 301 can be coupled to a vehicle 380 and used to move, roll and/or unroll a substantially cylindrical roll (not shown in FIGS. 10-18) along a surface, such as a floor, rooftop, field or the like. The vehicle 380 can be any device of the types shown and described herein for carrying and/or moving people and/or objects. The substantially cylindrical roll (or object) can be any substantially cylindrical object of the types shown and described herein.

The rolling and/or unrolling device 301 includes a frame assembly 300, a set of rollers 360 coupled to the frame assembly 300, and a height adjustment mechanism 365. The frame assembly 300 includes a vehicle coupling portion 310 and a roller portion 330. The vehicle coupling portion 310 can be removably coupled to the front portion of the vehicle 380. The vehicle coupling portion 310 includes a first (or upper) coupling frame member 311, a second (or lower) coupling frame member 314 and a third (or central) coupling frame member 322.

Figure 12:
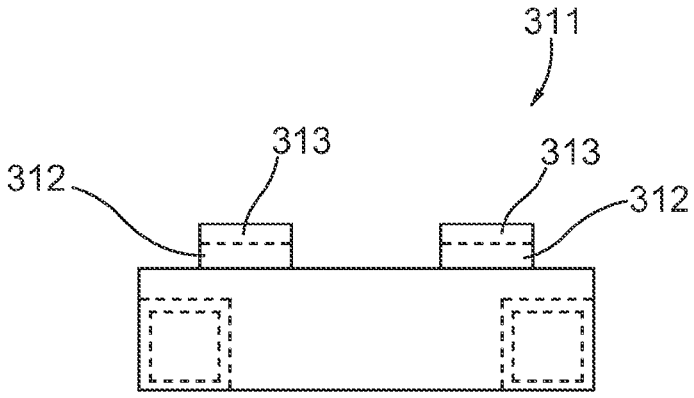
FIGS. 12-14 are a top view, a side view and a front view, respectively, of portion of a vehicle mounting frame of the device shown in FIGS. 10 and 11.
Figure 13:
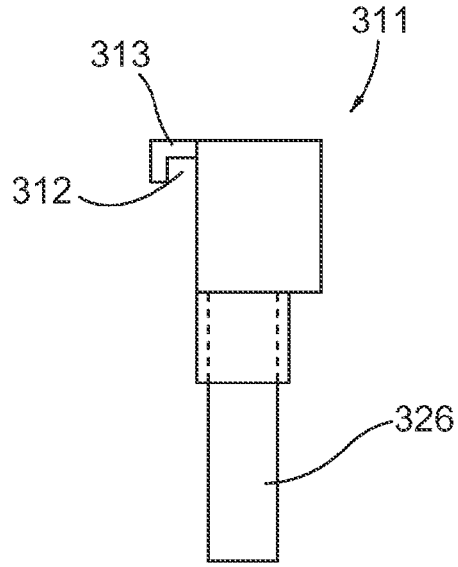
Figure 14:
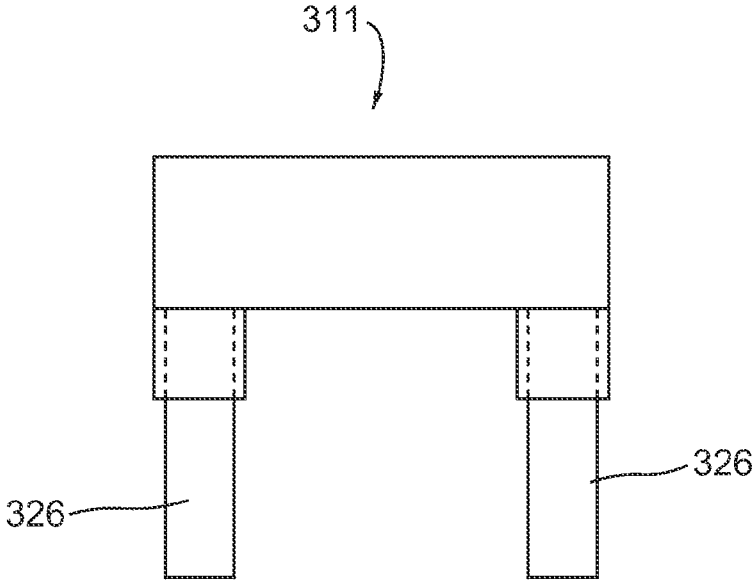

As shown in FIGS. 12-14, the first coupling frame member 311 includes two protrusions 313 and two telescoping portions 326. The protrusions 313 collectively define a channel 312 configured to receive a portion of a mounting protrusion or ridge 383 disposed on the top portion of the vehicle 380 (see e.g., FIG. 11). In this manner, when the frame assembly 300 is coupled to the vehicle 380, the engagement between the mounting protrusion 383 and the channel 312 limits movement of the frame assembly 300 relative to the vehicle 380. The two telescoping portions 326 are slidably received within the third coupling frame member 322 (see e.g., FIG. 11). In this manner the height or distance between the first coupling frame member 311 and the second coupling frame member 322 can be adjusted, as shown by the arrow FF in FIG. 11, to accommodate vehicles having different styles and/or sizes of mounting protrusions. The first coupling frame member 311 can be maintained in a fixed position by a pair of lock screws (or T-bolts) 323.

Figure 15:
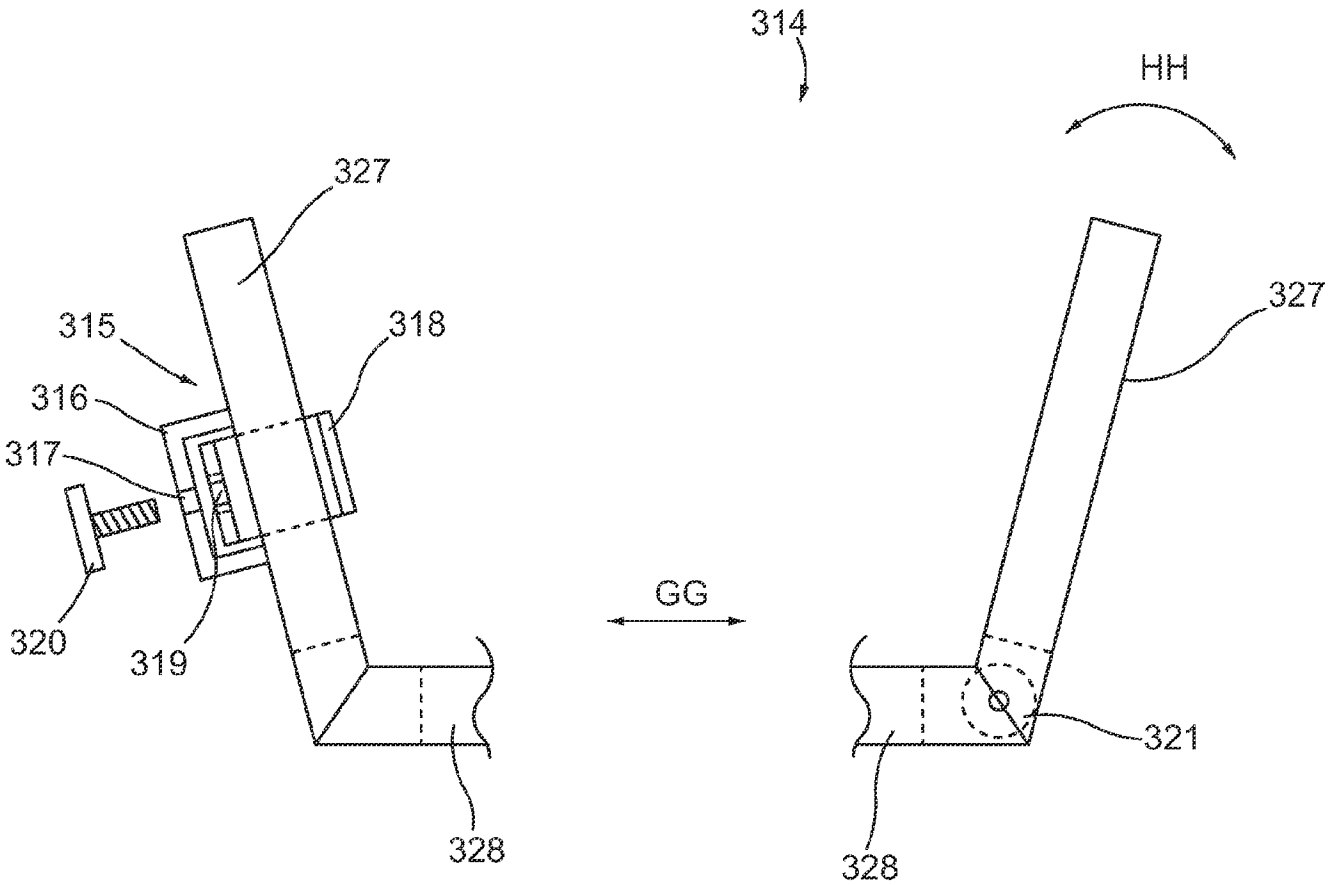
FIG. 15 is a top view of a portion of a vehicle mounting frame of the device shown in FIGS. 10 and 11.
Figure 16:
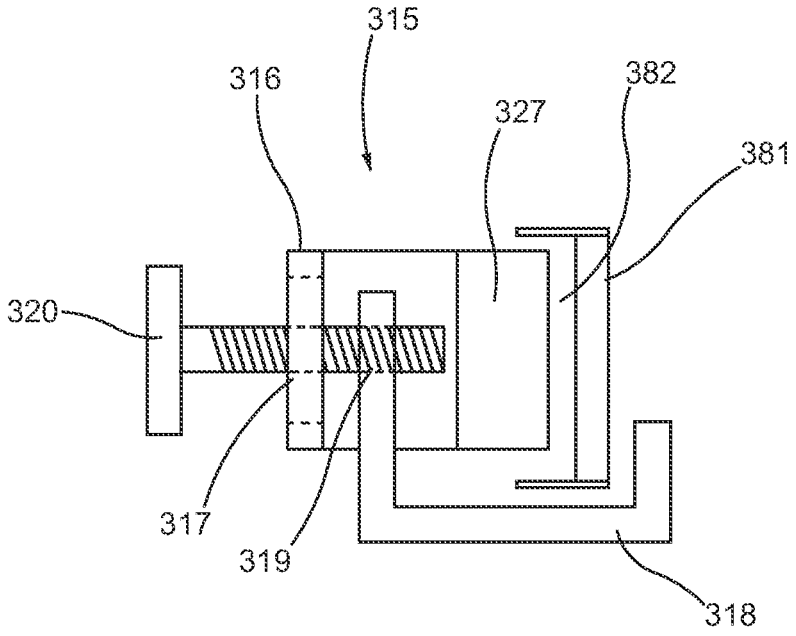
FIG. 16 is a front view of a clamp assembly of the device shown in FIGS. 10 and 11.
Figure 17:
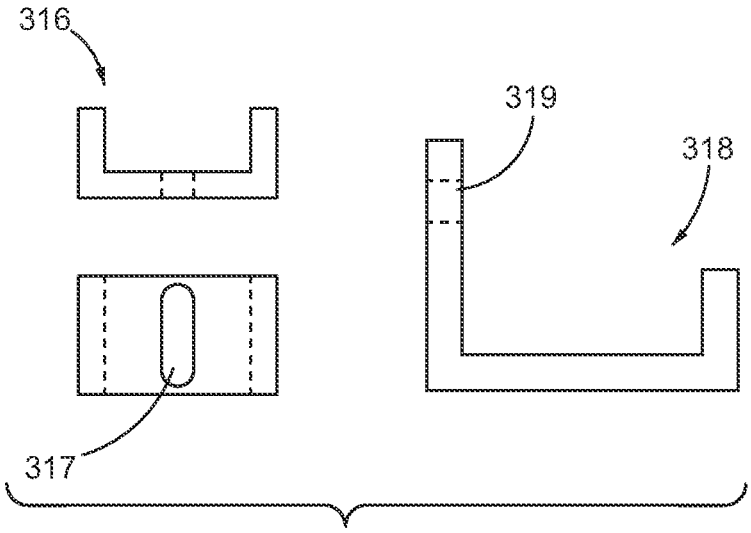
FIG. 17 shows various views of portions of the clamp assembly shown in FIG. 16.

As shown in FIGS. 15-17, the second coupling frame member 314 includes two bumper mounts 327 and two sliding portions 328. Note that FIG. 10 does not show the second coupling frame member 314. Each of the bumper mounts 327 is configured to be received within a bumper channel 382 defined by a bumper 381 of the lower portion of the vehicle 380 (see e.g., FIGS. 10 and 15). Each of the bumper mounts 327 includes a clamp assembly 315 (only one clamp assembly is shown in FIG. 15) such that the bumper mounts 327 can be coupled within the bumper channel 382. In this manner, when the frame assembly 300 is coupled to the vehicle 380, the engagement between the bumper mounts 327 and the bumper channel 382 limits movement of the frame assembly 300 relative to the vehicle 380.

Each of the clamp assemblies 315 includes a clamp boss 316, a clamp member 318 and a fastener 320. The clamp boss 316 is fixedly coupled to (e.g., welded to) the bumper mount 327, and defines an opening 317. As shown in FIG. 17, the clamp member 318 is a C-shaped channel that can move relative to the bumper mount 327. In particular, the clamp member 318 defines a threaded opening 319. As shown in FIG. 16, the fastener 320 is disposed through the opening 317 of the clamp boss 316 and is threaded into the threaded opening 319 of the clamp member 318. When the bumper mount 327 is disposed within the bumper channel 382 (see e.g. FIG. 16), the fastener 320 can be tightened to draw the clamp member 318 against the side of the vehicle 380 to secure the bumper mount 327 within the bumper channel 382.

Figure 18:
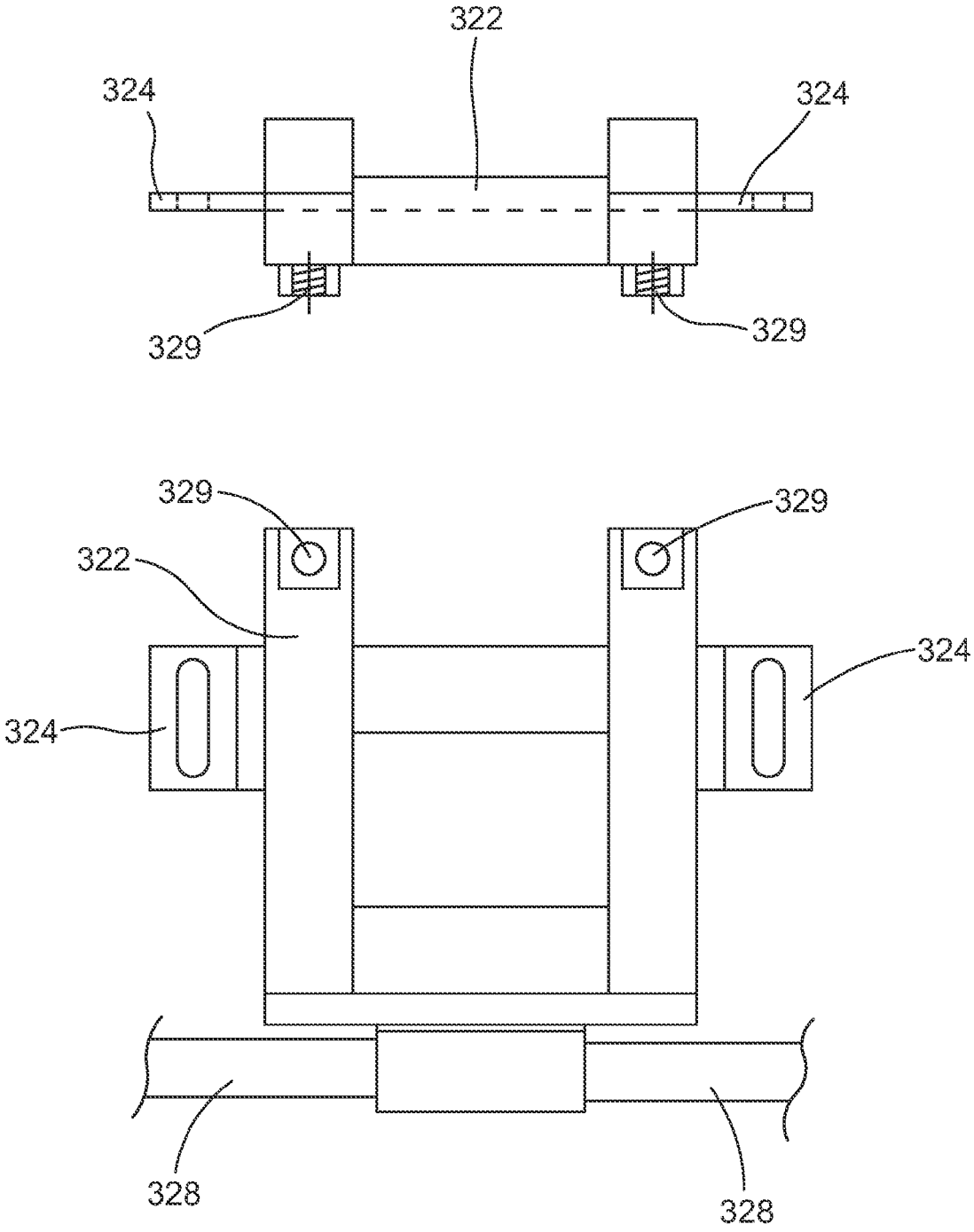
FIG. 18 shows a top view and a front view of a portion of a vehicle mounting frame of the device shown in FIGS. 10 and 11.

Each sliding portion 328 is slidably received within the third coupling frame member 322 (see e.g., FIG. 18). In this manner the width (or distance) between the bumper mounts 327 can be adjusted, as shown by the arrow GG in FIG. 15, to accommodate vehicles having different bumpers, styles and/or sizes. The sliding portions 328 can be maintained in a fixed position within the third coupling frame member 322 by any suitable mechanism.

Each sliding portion 328 is movably coupled to the corresponding bumper mount 327. More particularly, as shown in FIG. 15, each sliding portion 328 is coupled to the corresponding bumper mount 327 by a hinge 321 (only one hinge 321 is shown in FIG. 15). In this manner the width (or distance) and/or the angle between the bumper mounts 327 can be adjusted, as shown by the arrow HH in FIG. 15, to accommodate vehicles having different bumpers, styles and/or sizes. In some embodiments, the portion of the bumper mount 327 that engages the portion of the sliding portion 328 can be beveled, rounded and/or chamfered to limit the range of angular motion of the bumper mounts 327 relative to the sliding portions 328. Similarly, in some embodiments, the portion of the sliding portion 328 that engages the portion of the bumper mount 327 can be beveled, rounded and/or chamfered.

As shown in FIG. 18, the third coupling frame member 322 includes two mounting tabs 324, and defines two threaded openings 329 that receive the lock screws (or T-bolts) 323 to maintain the first coupling frame member 310 in a fixed location relative to the third coupling frame member 322. Each mounting tab 324 defines a slot through which an adjustment fastener 325 can be disposed (see e.g., FIG. 11).

As shown in FIGS. 10 and 11, the third coupling frame member 322 is adjustably coupled to the roller portion 330 of the frame assembly 300. More particularly, the third coupling frame member 322 is coupled to the lower portion of the roller portion 330 by a hinge 338. The third coupling frame member 322 is coupled to the upper portion of the roller portion 330 by the two adjustment fasteners 325, which can be threaded into the openings 336. Note that the third coupling frame member 322 is not shown as being coupled to the upper portion of the roller portion 330 by the two adjustment fasteners 325 in FIGS. 10 and 11. In use, the angular orientation of the roller portion 330 relative to the vehicle coupling portion 310, as shown by the arrow II in FIG. 11, can be adjusted by tightening or loosening the two adjustment fasteners 325. In this manner, the angle of the roller portion 330 relative to the surface upon which the cylindrical roll is disposed can be adjusted.

Figure 19:
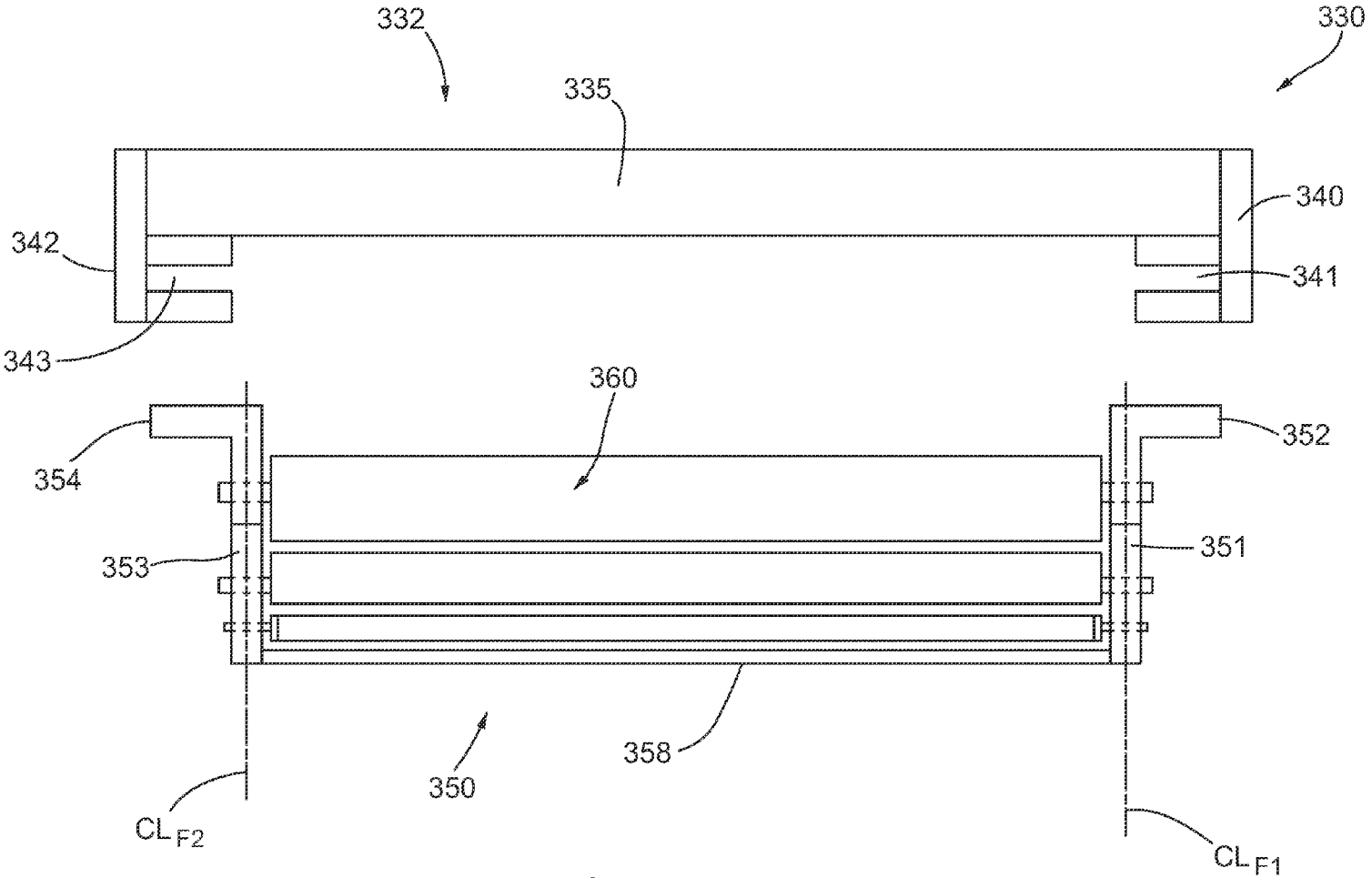
FIG. 19 is a top view of a roller portion of the device shown in FIGS. 10 and 11.

As shown in FIGS. 10, 11 and 19, the roller portion 330 of the frame assembly 300 includes a slide frame 332 and a roller frame 350 that is slidably coupled to and/or mounted within the slide frame 332. The slide frame 332 is coupled to vehicle coupling portion 310, and more particularly, the third coupling frame member 322, by the hinge 338 and the two adjustment fasteners 325, as described above.

Figure 20:
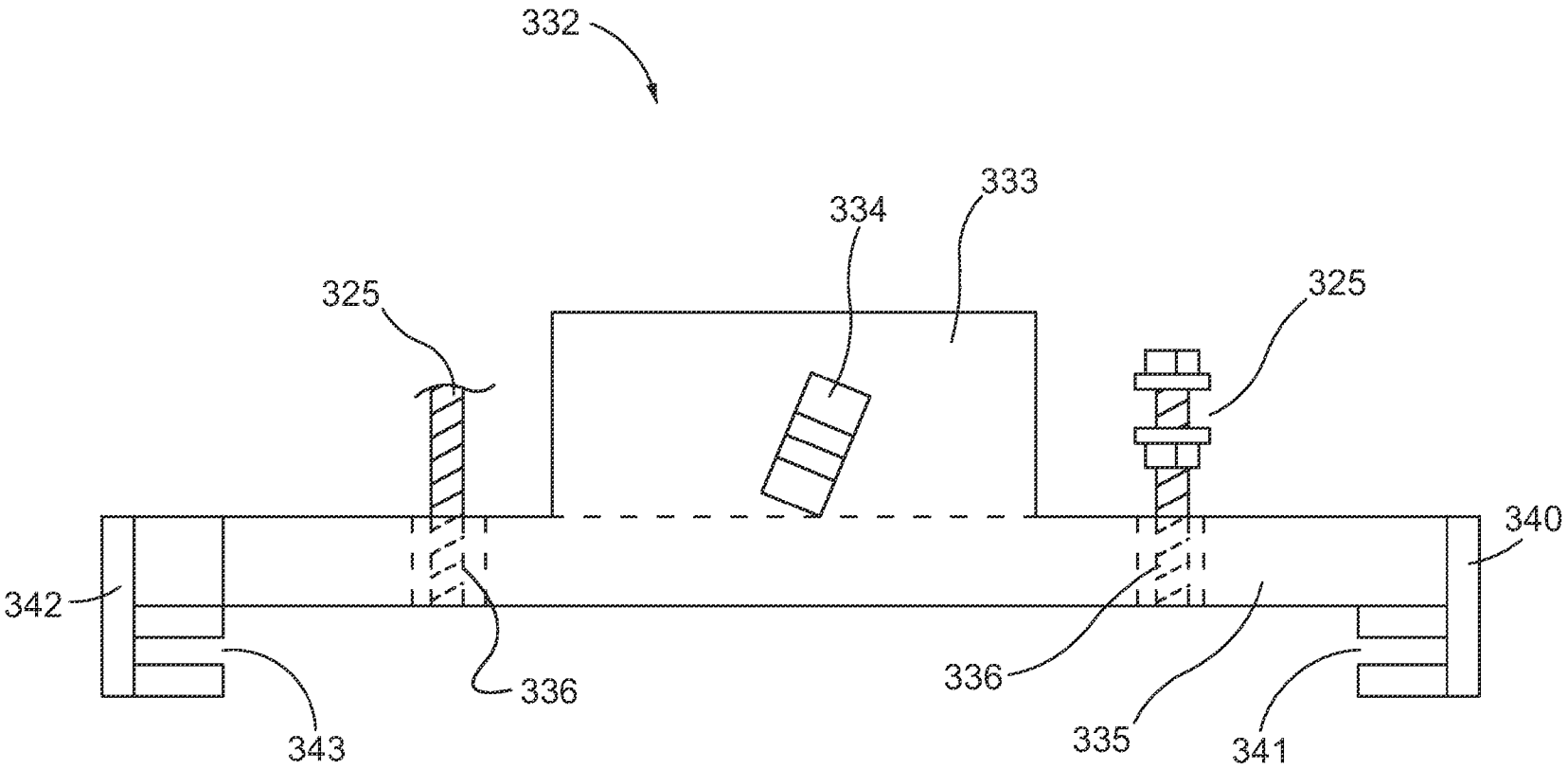
FIGS. 20 and 21 are a top view and a front view, respectively, of a slide frame of the roller portion shown in FIG. 19.
Figure 21:
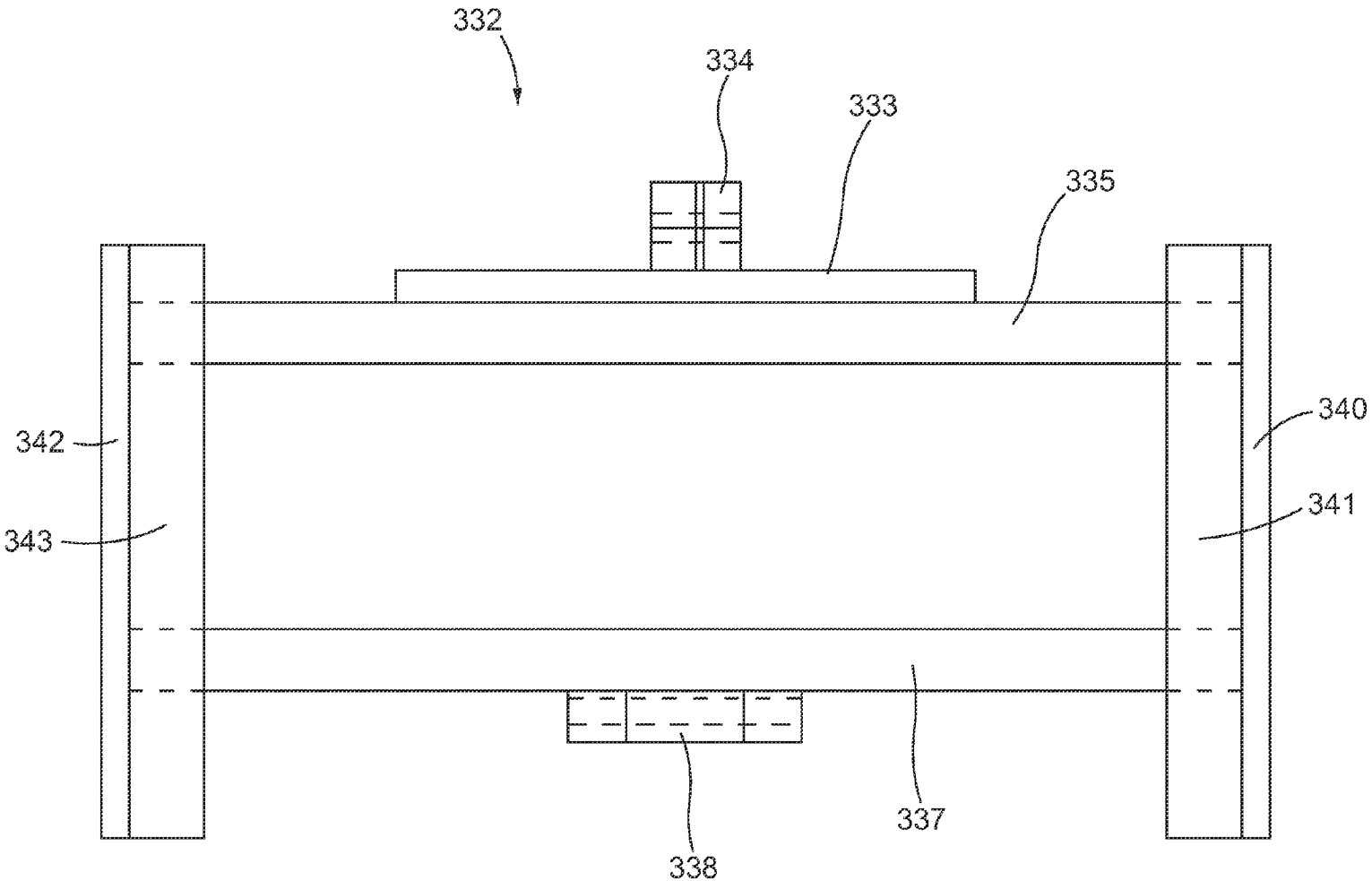

As shown in FIGS. 19-21, the slide frame 332 includes a mounting portion 333, a first slide member 340, a second slide member 342, a first cross brace 335 and a second cross brace 337. The mounting portion 333 includes a mounting protrusion 334 configured to be coupled to a portion of the height adjustment mechanism 365 (see e.g., FIG. 10). In this manner, the height adjustment mechanism 365 can be coupled to the roller portion 330 of the frame assembly 300.

The first slide member 340 defines a slot 341, and the second slide member 342 defines a slot 343. The slot 341 receives the protrusion 352 of the roller frame 350, and the slot 343 receives the protrusion 354 of the roller frame 350. Similarly stated, the slot 341 and the slot 343 cooperatively and slidably receive portions of the roller frame 350 such that the roller frame 350 can translate relative to the slide frame 332.

First slide member 340 is coupled to the second slide member 342 by the first (or upper) cross brace 335 and the second (or lower) cross brace 337. The first cross brace 335 defines the threaded openings 336 within which the adjustment fasteners 325 can be threadedly coupled, as described above. The second cross brace 337 includes a mounting portion to which the hinge 338 can be coupled.

Figure 22:
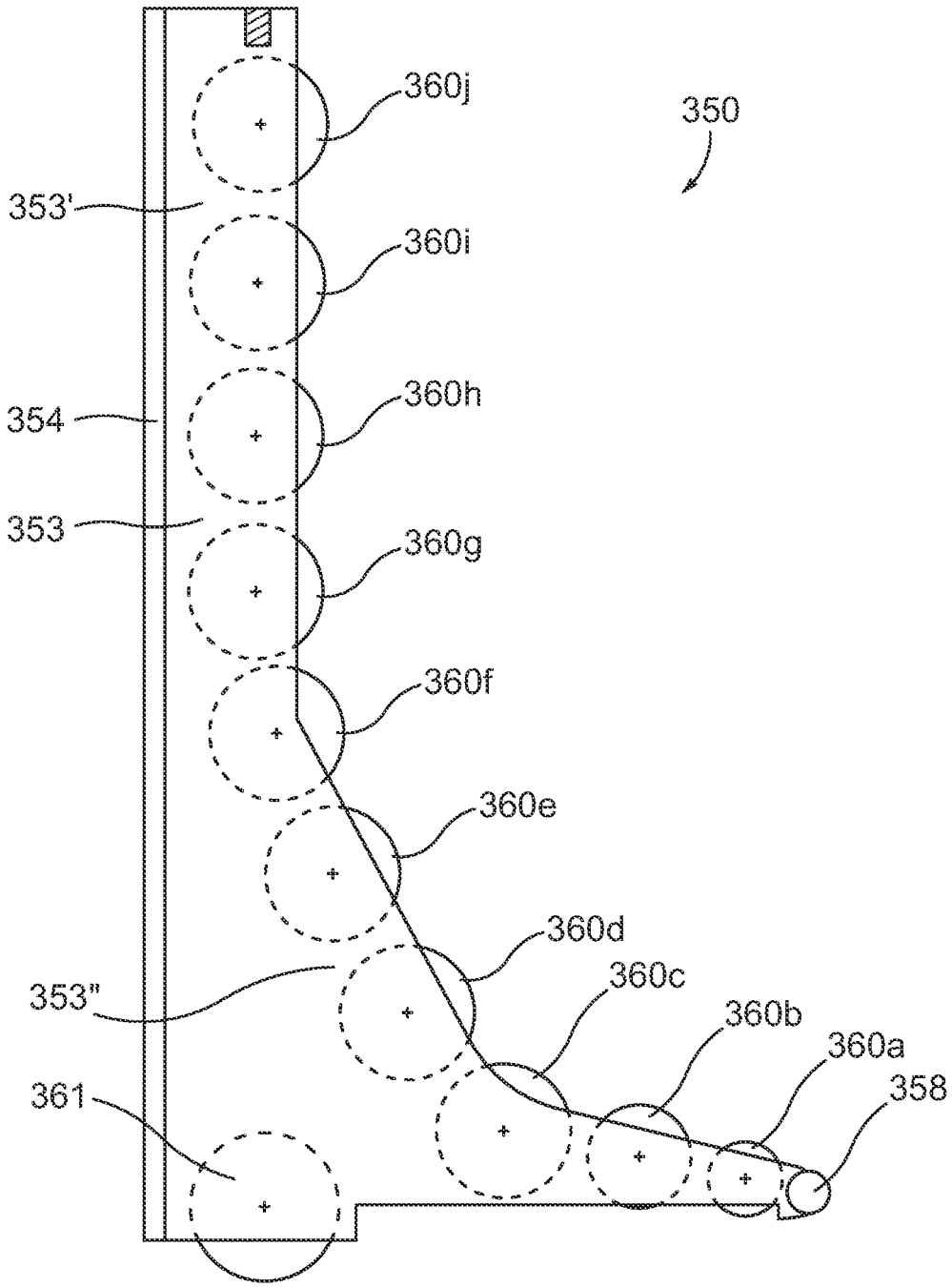
FIG. 22 is a side view of a roller frame of the roller portion shown in FIG. 19.

As shown in FIGS. 19 and 22, the roller frame 350 includes a frame member 351 and a frame member 353 to which and/or between which the rollers 360 are mounted. The frame member 351 is substantially parallel to the frame member 353. Similarly stated, a center line $CL_{F1}$ of the frame member 351 is substantially parallel to a center line $CL_{F2}$ of the frame member 353. In this manner, the frame member 351 is spaced apart from the frame member 353 by a distance that substantially corresponds to the length of the rollers 360.

The frame member 351 includes a linear portion and a contoured portion. The frame member 353 includes a linear portion 353' and a contoured portion 353". The contoured portion 353" of the frame member 353 can be seen, for example, in FIG. 22 (since FIG. 22 is a side view, only the frame member 353 is shown). A first subset of the rollers 360 (particularly, rollers 360*g*, 360*h*, 360*i* and 360*j*) are coupled to and/or between the linear portion of the frame member 351 and the linear portion 353' of the frame member 353. Accordingly, the axes of rotation of the subset 360' the rollers 360 is linearly aligned. A second subset of rollers (particularly, rollers 360*a*, 360*b*, 360*c*, 360*d*, 360*e* and 360*f*) are coupled to and/or between the contoured portions of the frame members 351, 353. In this manner, the axes of rotation of at least three of the rollers 360 (e.g., 360*b*, 360*c* and 360*d*) can be nonlinearly aligned. Similarly stated, the axes of rotation of at least three of the rollers 360 can define a curved surface. In some embodiments, the radius of curvature of the contoured portion 353' and/or the curved surface defined by the axes of rotation of at least three of the rollers 360 can substantially correspond to diameter of the substantially cylindrical roll.

The rollers 360 can each be any suitable roller (e.g., a cylindrical roller having an outer "roller" member that rotates about a spindle). In particular, the rollers 360 can have different sizes (e.g., diameters) to facilitate engaging a substantially cylindrical roll. In some embodiments, the roller 360*a* can have a nominal diameter of 1 inch, the roller 360*b* can have a nominal diameter of 1⅜ inch and the rollers 360*c*-360*j* can have a nominal diameter of 1⅞ inch.

A roller 361 is coupled to the rear portion of the roller frame 350. In use, the roller 361 can roll along the surface upon which the cylindrical roll to be manipulated is disposed. In addition to providing support for the roller portion 330 of the device 301, the roller 361 can roll along the unrolled portion of the material from the substantially cylindrical roll to assist in maintaining the unrolled portion of the material flat against the surface. In other embodiments, however, the roller portion 330 need not include the roller 361.

In some embodiments, the roller frame 350 can include a deflection plate (not shown) coupled to the bottom portion of the roller frame 350 and/or the slide frame 330. In use, the deflection plate can deflect the leading edge of the unrolled portion of the material from the substantially cylindrical roll downward towards and/or under the roller 361. This arrangement can prevent the leading edge of the unrolled portion from curling upwards and obstructing the operation of the device 301.

The roll support member 358 is substantially cylindrical member coupled to the frame 350 and is configured to provide support for the substantially cylindrical roll as it is rolled, unrolled and/or moved along the surface. The roll support member 358 can have any suitable size, such as for example, a diameter of approximately ⅝ inch.

As shown in FIG. 10, the height adjustment mechanism 365 includes a lift frame 370, a cable 375, a control lever 376, a pulley 356 and a pulley 374. The lift frame 370 includes a boom 373 coupled to the vehicle 380 and the frame assembly 300 by a first support member 371 and a second support member 372, respectively. The control lever 376 is pivotably coupled to the boom 373. A first end portion of the cable 375 is coupled to the control lever 376. The second end portion of the cable 375 is disposed about the pulley 374, around the pulley 356 (which is coupled to the roller frame 350) and is coupled to the boom 373.

In use, the height adjustment mechanism 365 can be used to move the roller frame 350 within and/or relative to the slide frame 330. In particular, the roller frame 350 can be raised and/or lowered relative to the surface by moving the control lever 376, as shown by the arrow JJ. The movement of the control lever 376 causes the cable 375 to move, thereby producing a force on the pulley 356 to move the roller frame, as shown by the arrow KK. In some embodiments, the control lever 376, the boom 373 and/or the first support member 371 can include detents and/or other locking mechanisms to limit the movement of the control lever 373 (and therefore the roller frame 350).

When the roller frame 350 is in the "lowered" position, the roller 361 can contact the surface, while the rollers 360 are spaced apart from the surface. In this manner, as described above, the roller portion 330 of the frame 300 and the rollers 360 will not scrape, contact and/or scratch the surface and/or the unrolled portion of the substantially cylindrical roll when the device 301 is used to move, roll and/or unroll the substantially cylindrical roll along the surface.

The device 301 can be used to move, roll and/or unroll any suitable substantially cylindrical roll, as described above. For example, in certain situations, the device 301 can contact a substantially cylindrical roll such that at least one of the rollers 360 (e.g., roller 360*a*, roller 360*b* or any of the rollers coupled to and/or between the contoured portions of the frame members 351, 353) contacts an outer surface of the substantially cylindrical roll along a contact portion, similar to the contact portion CPa shown and described above with reference to FIG. 2. In certain situations, the device 301 can contact a substantially cylindrical roll such that at least one of the rollers 360 (e.g., roller 360*a*, roller 360*b* or any of the rollers coupled to and/or between the contoured portions of the frame members 351, 353) contacts the substantially cylindrical roll at a location between the surface and a horizontal center line of the substantially cylindrical roll, as described above with reference to FIGS. 1 and 3.

Figure 23:
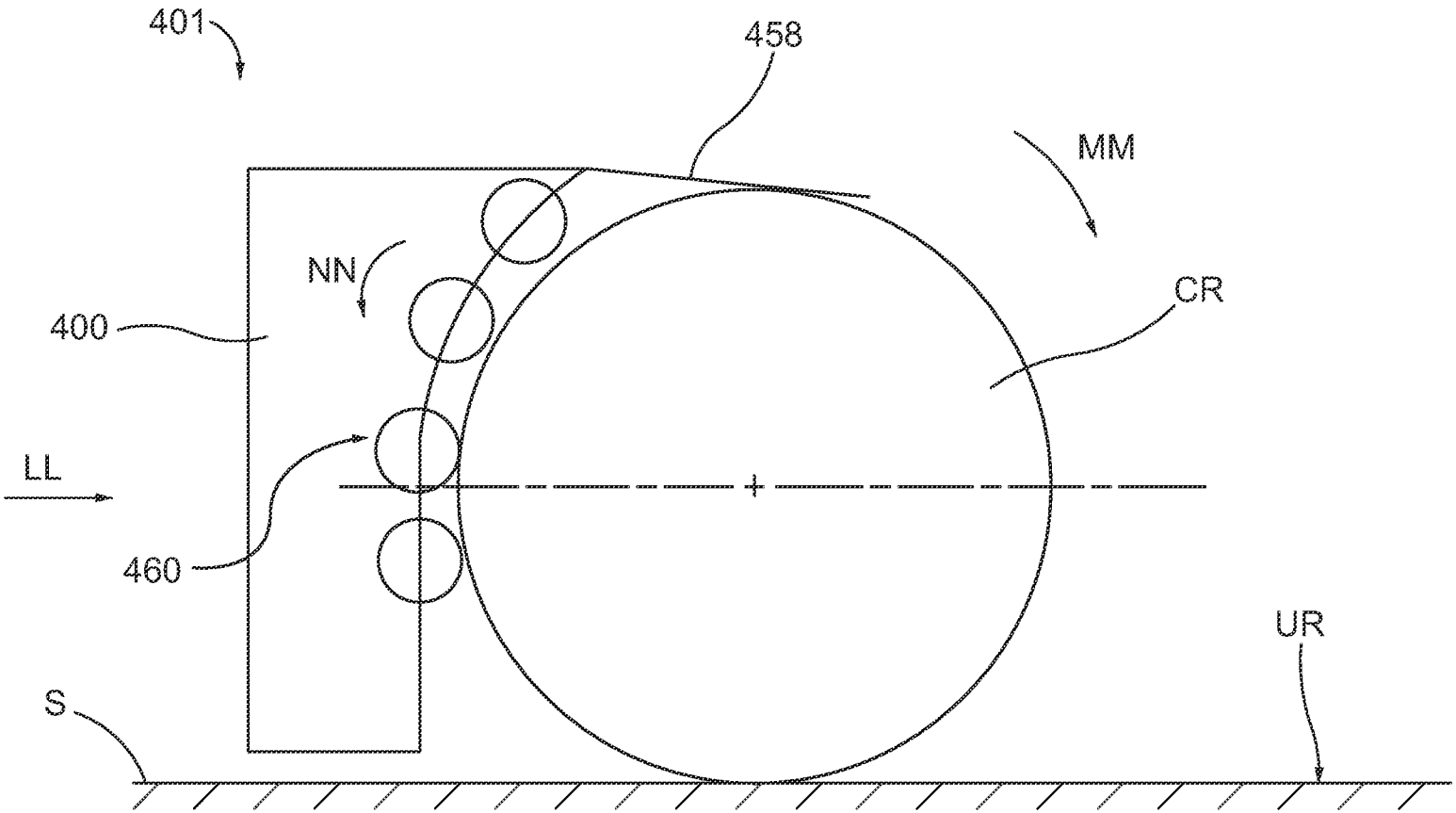
FIG. 23 is a side view of a roller assembly of a rolling device, according to an embodiment.

Although the devices are shown and described herein as including at least one roller that contacts the substantially cylindrical roll at a location between the surface and a horizontal center line of the substantially cylindrical roll (i.e., the "lower half" of the roll), in other embodiments, a device can include at least one roller that contacts the substantially cylindrical roll at a location between the top of the substantially cylindrical roll and a horizontal center line (i.e., the "upper half"). Although the devices are shown and described herein as being used to unroll and/or distribute the material from a substantially cylindrical roll, in some embodiments device can be used "roll up" a material (e.g., to take up a carpet from a surface). For example, FIG. 23 is schematic illustration of a side view of a roller assembly 401 for rolling up a carpet from a surface S into and/or about a roll CR. The roller assembly 401 can be coupled to a vehicle (not shown in FIG. 23). The roller assembly 401 can be coupled directly to the vehicle, a vehicle coupling frame and/or an adapter, such as those used in the embodiments described above.

The roller assembly 401 includes a frame 400, a roll support member 458 and a set of rollers 460. The rollers 460 are coupled to the frame 400 such that the rollers 460 can rotate with respect to the frame 400 and the roll CR. The roll support member 458 of the roller assembly 401 is configured to guide the roll CR and/or exert a downward force on the roll CR as the roller assembly 401 is moved in a direction shown by the arrow LL in FIG. 23. In some embodiments, the carpet support member 458 is spring-loaded such that as the unrolled portion UR of the material is added to (or "rolled onto") the roll CR, the distance between the surface S to roll support member 458 increases. This arrangement allows the carpet support member 458 to continuously exert a downward force on the roll CR as the roll CR is rolled up. In other embodiments, the roll support member 458 can include one or more rollers to provide rolling contact with the roll CR. In yet other embodiments, the roller assembly 401 need not include a roll support member 458.

In use, when the roller assembly 401 is moved in a direction shown by the arrow LL in FIG. 23, the roll CR rotates in the direction shown by the arrow MM in FIG. 23 and the rollers 460 rotate in the direction shown by the arrow NN in FIG. 23. Moreover, at least one of the rollers 460 contacts the outer surface of the roll CR at a location between the top of the roll CR and a horizontal center line $CL_H$ defined by the roll CR. As the roll CR rotates, the roll support member 458 can exerts a downward force on the roll CR. The combination of the movement of the carpet roll CR and the guidance and/or downward force on the roll CR causes the unrolled portion UR of the material to be added to the roll CR in a controlled and/or uniform manner.

While various embodiments have been described above, it should be understood that they have been presented by way of example only, and not limitation. Where methods described above indicate certain events occurring in certain order, the ordering of certain events may be modified. Additionally, certain of the events may be performed concurrently in a parallel process when possible, as well as performed sequentially as described above. Where illustrations shown and described above indicate certain components arranged in certain positions and/or orientations relative to other components, the arrangement of components may be modified.

Although the vehicles shown, described and referenced herein are described primarily as being industrial vehicles and/or scooters, any of the vehicles shown, described and/or referenced herein can be any device for carrying and/or moving people and/or objects. A vehicle to which the rolling and/or unrolling devices described herein can be coupled can be either a "motorized" vehicle or a "manual" (i.e., human-powered) vehicle. Similarly stated, a vehicle can include a machine to convert stored energy into motion (e.g., an electric motor, a pneumatic or hydraulic motor, an engine, fuel cell, pneumatic powered motor, fluid machine), or can include a manual mechanism requiring human force to produce motion. Examples of "motorized" vehicles to which the rolling and/or unrolling devices described herein can be coupled include industrial utility carts, scooters, forklifts or the like. Examples of "manual" vehicles to which the rolling and/or unrolling devices described herein can be coupled include pedal vehicles, manual pallet movers or the like.

Although the vehicle 180 is shown as being a wheeled-vehicle, in other embodiments, the vehicle 180 can have any suitable mechanism for moving move along the surface S. For example, in some embodiments, a vehicle to which the rolling and/or unrolling devices described herein can be coupled can be a tracked vehicle.

Although the substantially cylindrical roll or objects that are acted upon by the rolling and/or unrolling devices described herein are described primarily as being carpet rolls, the rolling and/or unrolling devices described herein can be used to roll any substantially cylindrical object. In some embodiments, the substantially cylindrical object can be a roll of material that is to be unrolled and/or distributed over a surface. The material to be unrolled can be, for example, carpet, floor covering, roofing material, fabric, vinyl, paper, sod or the like. In other embodiments, the substantially cylindrical object can be an object that is not unrolled or distributed, such as for example, a barrel, a shipping tube, drainage pipes or the like.

In some embodiments, for example, the apparatus can be used to unroll and/or install any material stored on substantially cylindrical rolls (not just carpet). For example, the apparatus can be used to unroll and/or install subflooring, plastic sheets, tarps, and/or the like.

Although the substantially cylindrical rolls are shown and described herein as being substantially similar, the devices and methods described herein can be used to roll, unroll, rotate and/or move objects having any suitable shape along a surface. For example, the devices shown herein can be used to roll, unroll, rotate and/or move an object having an oval, oblong and/or non-circular cross-sectional shape.

Although the rollers are shown and described above as being primarily cylindrical rollers, in other embodiments a device can include any suitable type of roller. For example in some embodiments, a rolling and/or unrolling device can include a substantially spherical roller. In other embodiments, a rolling and/or unrolling device can include one or more rollers having a tapered and/or conical shape. Tapered and/or conical rollers can be used, for example on opposing ends of a roll to ensure that the roll is rolled, unrolled and/or moved along the surface in a straight and/or uniform manner.

Although the height adjustment mechanism 365 is shown and described above as including a pulley and cable system, in other embodiments, a height adjustment mechanism can include any suitable mechanism for moving a roller frame (e.g., a hydraulic system and/or the like).

Although the devices shown and described above include a set of rollers (e.g., rollers 360) that rotate when an external force from the substantially cylindrical roll is applied thereto, in other embodiments, a roller assembly can include one or more rollers coupled to an external device configured to cause the rollers to rotate. For example, in some embodiments, a roller assembly can include an electric motor, hydraulic motor, pneumatic motor or the like operably coupled to one or more rollers. In use, the user can actuate the motor to cause the rollers to roll in a predetermined direction and/or at a predetermined speed. In this manner, the motorized rollers can impart a rotational force on the carpet roll, thereby assisting the apparatus in rolling up and/or unrolling the carpet roll.

Although various embodiments have been described as having particular features and/or combinations of components, other embodiments are possible having a combination of any features and/or components from any of embodiments where appropriate. For example, the roller portion 330 shown and described above can include the rollers 360 mounted thereto in a manner that produces one or more contact portions with a substantially cylindrical roll similar to the contact portions described above with reference to device 101.

What is claimed is:

1. An apparatus, comprising:

a frame having a vehicle coupling portion and a roller portion, the vehicle coupling portion configured to be coupled to a vehicle, the vehicle configured to move along a surface to distribute a substantially cylindrical roll about the surface such that a diameter of the substantially cylindrical roll is decreased from a first diameter to a second diameter when the substantially cylindrical roll is distributed about the surface; and a plurality of rollers coupled to the roller portion of the frame such that a rotational axis about which a first roller from the plurality of rollers rotates is non-coaxial to a rotational axis about which a second roller from the plurality of rollers rotates, and such that when the vehicle coupling portion of the frame is coupled to the vehicle the first roller from the plurality of rollers and the second roller from the plurality of rollers are each disposed between the vehicle and a vertical center line of the substantially cylindrical roll, the first roller from the plurality of rollers is configured to contact a first contact portion of the substantially cylindrical roll when the substantially cylindrical roll has the first diameter, the first roller from the plurality of rollers being spaced apart from substantially cylindrical roll when the substantially cylindrical roll has the second diameter, the second roller from the plurality of rollers is configured to contact a second contact portion of the substantially cylindrical roll when the substantially cylindrical roll has the first diameter and when the substantially cylindrical roll has the second diameter, the second contact portion of the substantially cylindrical roll disposed between the surface and a horizontal center line of the substantially cylindrical roll.

2. The apparatus of claim 1, wherein:

the substantially cylindrical roll is a carpet roll; and the second roller is configured to transmit a force to the carpet roll to unroll the carpet roll when the vehicle coupling portion of the frame is coupled to the vehicle, the second roller is in contact with the second contact portion of the carpet roll, and the vehicle is moved along the surface.

3. The apparatus of claim 1, wherein:

the roller portion of the frame includes a first frame member and a second frame member, the first frame member and the second frame member being substantially parallel; and the first roller and the second roller are each a cylindrical roller coupled to the first frame member and the second frame member.

4. The apparatus of claim 3, wherein:

the first frame member is a first non-linear frame member and the second frame member is a second non-linear frame member.

5. The apparatus of claim 1, wherein:

the roller portion of the frame includes a first frame member and a second frame member, at least a portion of the first frame member and a portion of the second frame member being curved; and the rotational axis about which the first roller rotates is a first axis and the rotational axis about which the second roller rotates is a second axis, the plurality of rollers includes a third roller that rotates about a third axis, the third roller from the plurality of rollers being configured to contact a third contact portion of the substantially cylindrical roll, the first axis, the second axis, and the third axis being non-coaxial such that the first roller, the second roller, and the third roller are disposed non-linearly along the curved portion of the first frame member and the curved portion of the second frame member.

6. The apparatus of claim 1, wherein:

the first contact portion of the substantially cylindrical roll is disposed between the surface and the horizontal centerline when the substantially cylindrical roll has the first diameter.

7. The apparatus of claim 1, wherein:

the plurality of rollers includes a third roller configured to contact the substantially cylindrical roll when the substantially cylindrical roll has the first diameter, the rotational axis about which the first roller rotates is non-coaxial with the rotational axis about which the second roller rotates, the rotational axis about which the second roller rotates is non-coaxial with a rotational axis about which the third roller rotates.

8. The apparatus of claim 1, wherein:

the frame includes a roll support member coupled to the roller portion of the frame, the roll support member configured to contact a third contact portion of the substantially cylindrical roll when the vehicle coupling portion of the frame is coupled to the vehicle.

9. The apparatus of claim 1, wherein:

the roller portion of the frame is spaced apart from the surface by a distance when the vehicle coupling portion of the frame is coupled to the vehicle; and the roller portion of the frame is configured to move relative to the vehicle coupling portion of the frame such that the distance can be changed.

10. An apparatus, comprising:

a frame having a vehicle coupling portion and a roller portion, the vehicle coupling portion configured to be coupled to a vehicle, the vehicle configured to move along a surface to distribute a substantially cylindrical roll about the surface such that a diameter of the substantially cylindrical roll is decreased from a first diameter to a second diameter when the substantially cylindrical roll is distributed about the surface;

a first roller coupled to the roller portion of the frame, the first roller configured to rotate about a first axis;

a second roller coupled to the roller portion of the frame, the second roller configured to rotate about a second axis, the second axis being non-coaxial with the first axis; and a third roller coupled to the roller portion of the frame, the third roller configured to rotate about a third axis, the third axis being non-coaxial with the first axis and non-coaxial with the second axis, the roller portion of the frame configured such that when the vehicle coupling portion of the frame is coupled to the vehicle the first roller, the second roller, and the third roller are each spaced apart from the surface and at least one of the first roller, the second roller, or the third roller is configured to maintain contact with an outer surface of the substantially cylindrical roll when the substantially cylindrical roll has the first diameter and when the substantially cylindrical roll has the second diameter.

11. The apparatus of claim 10, wherein:

the first roller is configured to be spaced apart from the surface by a first distance, the second roller is configured to be spaced apart from the surface by a second distance different than the first distance, and the third roller is configured to be spaced apart from the surface by a third distance different from the second distance; and the roller portion of the frame is configured to move within a channel defined by the vehicle coupling portion of the frame such that the first distance, the second distance, and the third distance can be changed.

12. The apparatus of claim 10, wherein the first roller contacts a contact portion on the outer surface of the substantially cylindrical roll, the contact portion being disposed between the surface and a horizontal center line of the substantially cylindrical roll.

13. The apparatus of claim 10, wherein:

the roller portion of the frame includes a first non-linear frame member and a second non-linear frame member; and the first roller, the second roller, and the third roller are each coupled to the first non-linear frame member and the second non-linear frame member such that the first roller, the second roller, and the third roller are arranged in a non-linear path along the first non-linear frame member and the second non-linear frame member.

14. The apparatus of claim 10, wherein:

the roller portion of the frame includes a first frame member and a second frame member, at least a portion of the first frame member and a at least a portion of the second frame member being curved; and the first roller, the second roller, and the third roller are a cylindrical roller coupled to the first frame member and the second frame member such that the first roller, the second roller, and the third roller are arranged in a non-linear path along the curved portion of the first frame member and along the curved portion of the second frame member.

15. The apparatus of claim 10, wherein:

the first roller is configured to contact a first contact portion on the outer surface of the substantially cylindrical roll when the substantially cylindrical roll has the first diameter and is configured to be spaced apart from the first contact portion when the substantially cylindrical roll has the second diameter, the second roller is configured to contact a second contact portion of the substantially cylindrical roll when the substantially cylindrical roll has the first diameter and is configured to be spaced apart from the second contact portion when the substantially cylindrical roll has the second diameter, and the third roller is configured to contact a third contact portion of the substantially cylindrical roll when the substantially cylindrical roll has the first diameter and when the substantially cylindrical roll has the second diameter.

16. An apparatus, comprising:

a frame having a vehicle coupling portion and a roller portion, the vehicle coupling portion of the frame configured to be coupled to a vehicle, the vehicle configured to move along a surface to move a substantially cylindrical roll along the surface such that a diameter of the substantially cylindrical roll is decreased when the substantially cylindrical roll is distributed about the surface;

a plurality of rollers coupled to the roller portion of the frame such that when the vehicle coupling portion of the frame is coupled to the vehicle and the vehicle is moved along the surface, the plurality of rollers is configured to transmit a first force on a first contact portion of the substantially cylindrical roll to distribute the substantially cylindrical roll about the surface; and a roll support member coupled to the roller portion of the frame such that when the vehicle coupling portion of the frame is coupled to the vehicle and the vehicle is moved along the surface the roll support member is configured to transmit a second force on a second contact portion of the substantially cylindrical roll, the second contact portion of the substantially cylindrical roll disposed between the surface and a horizontal centerline of the substantially cylindrical roll.

17. The apparatus of claim 16, wherein:

the first contact portion of the substantially cylindrical roll is disposed between the surface and the horizontal center line of the substantially cylindrical roll, the first contact portion of the substantially cylindrical roll is disposed between the plurality of rollers in contact with the first contact portion and a vertical centerline of the substantially cylindrical roll.

18. The apparatus of claim 16, wherein:

the plurality of rollers includes a first roller and a second roller; and the first roller from the plurality of rollers is in contact with the first contact portion when the substantially cylindrical roll has a first diameter and is spaced apart from the first contact portion when the substantially cylindrical roll has a second diameter, the second roller from the plurality of rollers is in contact with the first contact portion when the substantially cylindrical roll has the first diameter and when the substantially cylindrical roll has the second diameter, the first diameter of the substantially cylindrical roll being greater than the second diameter of the substantially cylindrical roll.

19. The apparatus of claim 16, wherein:

the roller portion of the frame configured such that when the vehicle coupling portion of the frame is coupled to the vehicle the plurality of rollers is spaced apart from the surface by a distance, and the roller portion of the frame is configured to move within a channel defined by the vehicle coupling portion of the frame such that the distance can be changed.

* * * * *